US006651974B2

(12) United States Patent
Kawarama et al.

(10) Patent No.: US 6,651,974 B2
(45) Date of Patent: Nov. 25, 2003

(54) SHEET FEED APPARATUS AND RECORDING APPARATUS EQUIPPED WITH SHEET FEED APPARATUS

(75) Inventors: Makoto Kawarama, Kanagawa (JP); Toshiyuki Onishi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/078,437

(22) Filed: Feb. 21, 2002

(65) Prior Publication Data

US 2002/0117800 A1 Aug. 29, 2002

(30) Foreign Application Priority Data

Feb. 23, 2001 (JP) ..... 2001-047661
Feb. 23, 2001 (JP) ..... 2001-049039

(51) Int. Cl.[7] ..... B65H 3/52

(52) U.S. Cl. ..... 271/121; 271/104; 271/117; 271/109

(58) Field of Search ..... 271/121, 9.11, 271/109, 117, 107, 104, 137, 225, 9.06, 171

(56) References Cited

U.S. PATENT DOCUMENTS 5,540,427 A 7/1996 Nitta et al. ..... 271/274
5,725,319 A 3/1998 Saito et al. ..... 400/629
6,042,109 A * 3/2000 Klausbruckner ..... 271/225
6,065,886 A * 5/2000 Embry et al. ..... 400/629
6,170,817 B1 * 1/2001 Kawaguchi ..... 71/167
6,279,897 B1 * 8/2001 Richards ..... 271/121

* cited by examiner

*Primary Examiner*—Donald R. Walsh
*Assistant Examiner*—Kaitlin S Joerger
(74) *Attorney, Agent, or Firm*—Fitzpatrick, Cella, Harper & Scinto

(57) ABSTRACT

A sheet feed apparatus comprises a sheet stacking means, being able to be installed in and released from the main body of the apparatus, for stacking sheets, a sheet feed roller for feeding the sheets stacked on the sheet stacking means, and plural inclined plane members, disposed at the end of the downstream side of a sheet feed direction of the sheet stacking means, for coming into contact with the sheets fed by the sheet feed roller to separate them, wherein, among the plural inclined plane members, the height of the inclined plane member corresponding to the sheet feed roller is set to be lower than the height of the other inclined plane members, whereby a sheet feed cassette can be installed/released without any contact with the sheet feed roller, and the sheets can be fed without any fold of their edges.

18 Claims, 20 Drawing Sheets

SHEET FEED APPARATUS AND RECORDING APPARATUS EQUIPPED WITH SHEET FEED APPARATUS

BACKGROUND OF THE INVENTION

1. Field of the Invention

The present invention relates to a sheet feed apparatus and a recording apparatus which is equipped with the sheet feed apparatus. More particularly, the present invention relates to the sheet feed apparatus which separates sheets stacked on a sheet stacking means one by one and transports the separated sheets to an image recording unit, and the recording apparatus which is equipped with this sheet feed apparatus.

2. Related Background Art

Conventionally, a recording apparatus such as a printer, a copying machine, a facsimile machine or the like is ordinarily equipped with a sheet feed apparatus which feeds sheets to an image recording unit. As such the sheet feed apparatus, there is the structure that an inclined plane member is provided at the end on the downstream side of a sheet feed direction of a sheet stacking means, and the inclined plane member is set to come into contact with the sheets fed by a sheet feed means, whereby the sheet is separated one by one.

FIG. 22 is a schematic diagram showing the conventional sheet feed apparatus which applies a system of separating the sheet by using such the inclined plane member. In FIG. 22, numeral 215 denotes a sheet feed roller which acts as the sheet feed means, and numeral 214 denotes a sheet feed arm which rotatably holds the sheet feed roller 215 at its end and which is also rotatably held by an arm shaft 214*a*.

Numeral 210 denotes a sheet feed cassette which acts as the sheet stacking means on which sheets (or recording paper) P are stacked, and numeral 219 denotes an inclined plane member which comes into contact with the sheets P fed by the rotation of the sheet feed roller 215 and is thus used to separate the sheets P one by one. The inclined plane member 219 is provided at the end on the downstream side of the sheet feed direction of the sheet feed cassette 210.

Then, an uppermost recording sheet P1 fed by the sheet feed roller 215 is separated from the sheets P by the inclined plane member 219, and then transported to a not-shown image recording unit through a sheet transportation path R. At this time, it is desirable to set the height of the inclined plane member 219 high so that the sheet P1 fed by the sheet feed roller 215 passes the sheet transportation path R as it changes the direction upward along the inclined plane member 219.

Incidentally, in such the conventional sheet feed apparatus and the recording apparatus equipped with it, the sheet feed cassette 210 is detachably installed in the main body of the apparatus. If the sheet feed roller 215 comes into contact with the sheet feed cassette 210 when the cassette 210 is installed and released, the sheet feed roller 215 and the sheet feed cassette 210 might be damaged, whereby it is necessary to limit the height of the sheet feed cassette 210, and thus the height of the inclined plane member 219 is limited.

However, if the height of the inclined plane member 219 is limited as above, the sheet P1 fed by the sheet feed roller 215 passes the sheet transportation path R as it changes the direction upward along the inclined plane member 219 when the number of the sheets P stacked on the sheet feed cassette 210 is small. However, when the number of the sheets P stacked on the sheet feed cassette 210 is large, since the sheets P do not so change the direction even if the sheets P come into contact with the inclined plane member 219, the sheets P come into contact with a guide 220 constituting the sheet transportation path R at a sharp angle.

Then, if the sheets P come into contact with the guide 220 at such the sharp angle, the problems that the sheet can not be fed, the edge of the sheet is folded, and the like occur.

Further, there is a sheet feed apparatus which is equipped with a sheet stacking unit to stack the sheets thereon, a sheet feed unit to feed the sheets stacked on the sheet stacking unit to the downstream side of the sheet transportation direction, a sheet separation unit provided on the downstream side of the sheet stacking unit to separate the sheet fed from the sheet feed unit, and a sheet turnabout path to convert and guide the transportation direction of the sheet fed from the sheet stacking unit.

The sheet feed unit pushes the sheets on the sheet stacking unit against the sheet separation unit as feeding them, separates the sheets one by one, and then feeds the separated sheets to the sheet turnabout path. The sheet turnabout path guides the sheet, e.g., by ax making U-turn, to an image recording unit.

The purpose of U-turn transporting the sheet is to deal with the miniaturization by arranging the image recording unit above the sheet stacking unit to shorten the horizontal dimensions of the image recording unit and reduce the setup area of the recording apparatus.

However, if the sheet is U-turn transported like this, the problem that the height of the recording apparatus increases because the height of the sheet feed apparatus increases occurs.

SUMMARY OF THE INVENTION

An object of the present invention is to provide a sheet feed apparatus in/from which a sheet feed cassette can be installed/released without any contact with a sheet feed roller, and which can surely feed sheets without any fold of their edges, and a recording apparatus which is equipped with this sheet feed apparatus.

Another object of the present invention is to provide a sheet feed apparatus of which the height is low, and a recording apparatus which is equipped with this sheet feed apparatus.

Still another object of the present invention is to provide a sheet feed apparatus comprising: a sheet stacking means, being able to be installed in and released from the main body of the apparatus, for stacking sheets; a sheet feed roller for feeding the sheets stacked on the sheet stacking means; and plural inclined plane members, disposed at the end of the downstream side of a sheet feed direction of the sheet stacking means, for coming into contact with the sheets fed by the sheet feed roller to separate them, wherein, among the plural inclined plane members, the height of the inclined plane member corresponding to the sheet feed roller is set to be lower than the height of the other inclined plane members.

Still another object of the present invention is to provide a sheet feed apparatus comprising: a sheet stacking means for stacking sheets; a sheet feed roller for feeding the sheets stacked on the sheet stacking means; plural inclined plane members, disposed at the end of the downstream side of a sheet feed direction of the sheet stacking means, for coming into contact with the sheets fed by the sheet feed roller to separate them; and a reversal roller for reversing the sheet fed by the sheet feed roller, wherein the reversal roller has plural roller units, and each of the plural roller units is disposed between the inclined plane members in a sheet width direction.

DETAILED DESCRIPTION OF THE PREFERRED EMBODIMENTS

Hereinafter, the embodiments of the present invention will be explained in detail with reference to the attached drawings.

First Embodiment

Figure 1:
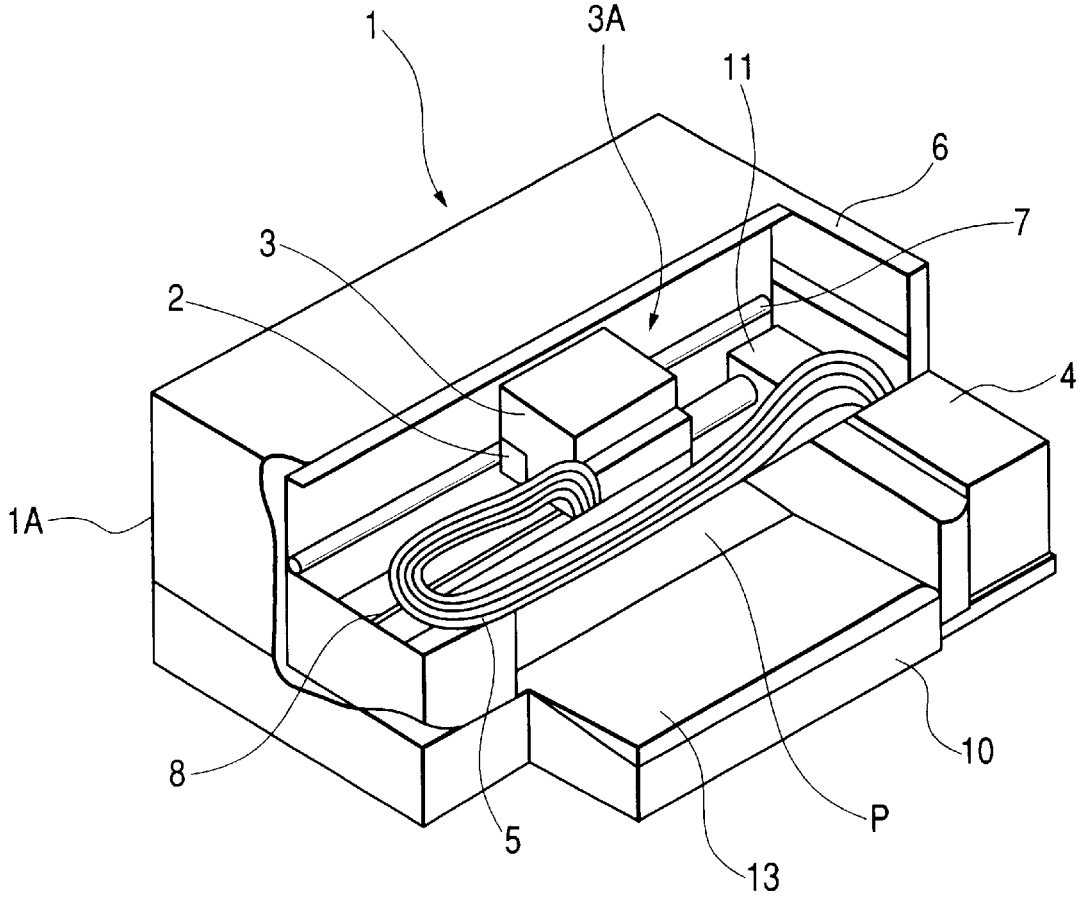
FIG. 1 is a perspective view showing an ink-jet printer which is an example of a recording apparatus equipped with a sheet feed apparatus according to the first embodiment of the present invention.

FIG. 1 is a perspective view showing an ink-jet printer being an example of a recording apparatus equipped with a sheet feed apparatus according to the embodiment of the present invention.

In FIG. 1, numeral 1 denotes the ink-jet printer, numeral 1A denotes a printer main body (hereinafter called a main body), and numeral 3A denotes an image recording unit. The image recording unit 3A has a recording head 3 and a carrier 2 used to mount the recording head 3.

The recording head 3 is structured to have plural nozzle arrays (not shown) in the sub scanning direction on the surface opposite to sheets P to discharge different color inks for each nozzle array. The ink is supplied to each color nozzle array in the recording head 3 from an ink tank 4 through a supply tube 5. The carrier 2 is slidably supported along a guide shaft 7 and a guide rail 8 each of which has both the ends fixed to a frame 6 of the main body 1A and which are mutually disposed in parallel.

Images are recorded on the sheet by discharging the ink toward the sheet P from the recording head 3 while reciprocating the carrier 2. It should be noted that the carrier 2 is reciprocated by a belt driving apparatus and a motor (both not shown).

Figure 2:
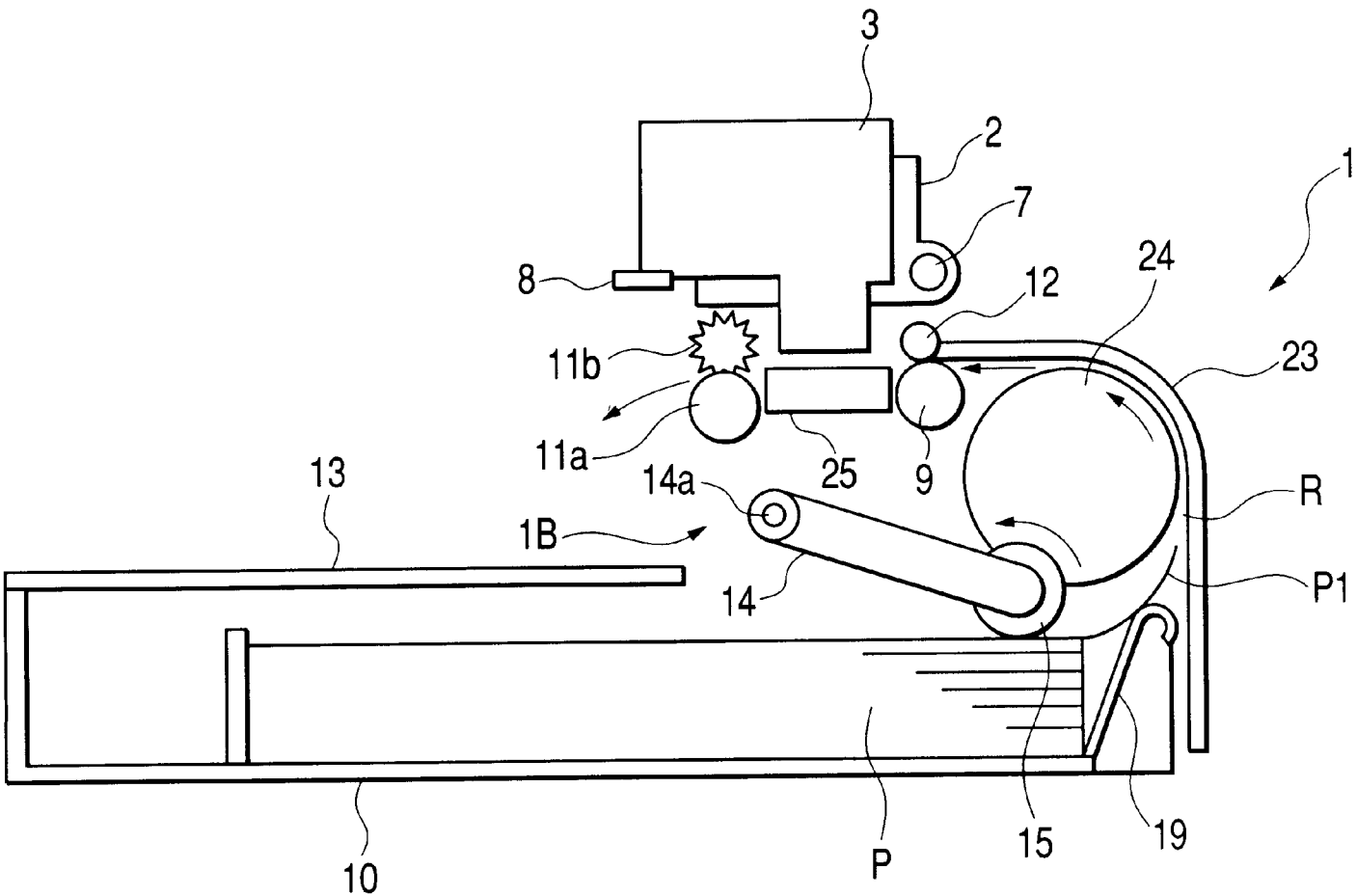
FIG. 2 is a sectional view showing the schematic structure of the ink-jet printer.

FIG. 2 is a sectional view showing the schematic structure of the ink-jet printer 1. In FIG. 2, numeral 1B denotes a sheet feed apparatus. The sheet feed apparatus 1B has a sheet feed cassette 10 being a sheet stacking means detachably installed in the main body 1A, and a sheet feed roller 15 being a sheet feed means to feed the sheets P stacked in the sheet feed cassette 10.

The sheet feed cassette 10 has a separation board 19 being an inclined plane member which is in contact with the sheets P fed by the rotation of the sheet feed roller 15 at the end of the downstream side of the sheet feed direction, so as to separate the sheet P.

The sheet feed roller 15 is provided above the sheet feed cassette 10. The roller 15 is held rotatively by an arm 14, being a supporting member, also rotatively supported by a fulcrum shaft 14*a* on the upstream side of the sheet feed roller 15, and in a state capable of closing to and leaving from the sheets P stacked on the sheet feed cassette 10.

Figure 3:
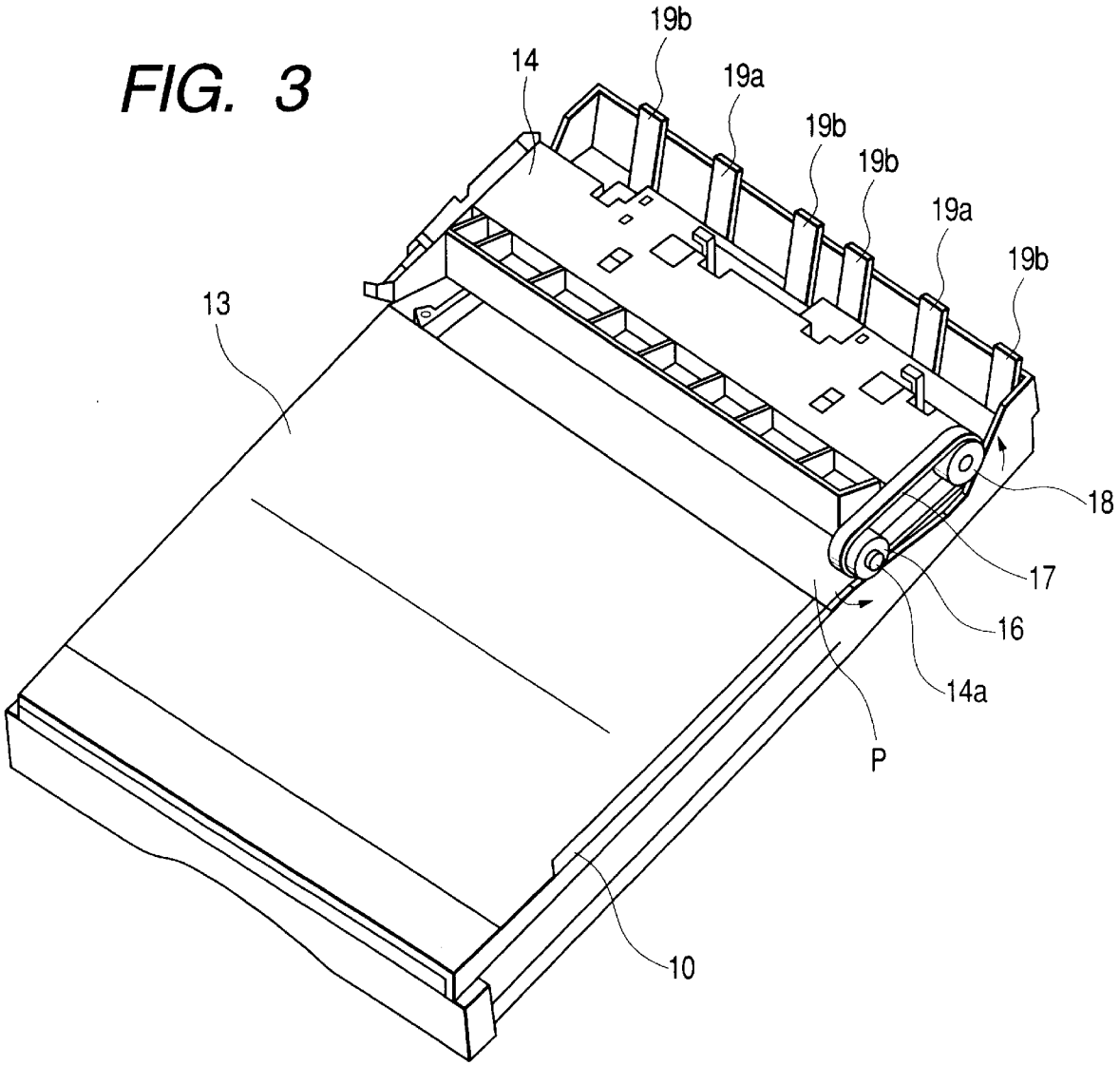
FIG. 3 is a perspective view showing the structure of a sheet feed cassette of the sheet feed apparatus.

When the images are recorded, the sheet feed roller 15 comes into contact with an uppermost sheet P1 of the sheets P stacked on the sheet feed cassette 10 owing to the weight of the roller 15 itself and the downward rotative motion of the arm 14. Then, the sheet feed roller 15 is rotated by the driving force from a not-shown driving source transmitted through a pulley 16, a belt 17 and a gear 18 shown in FIG. 3.

In FIG. 2, numeral 9 denotes a transportation roller, numeral 24 denotes a U-turn roller, and numeral 23 denotes a roller guide provided at the position opposite to the U-turn roller 24. The sheet P1 fed by the rotation of the sheet feed roller 15 is transported to the transportation roller 9 through a sheet transportation path R formed between the U-turn roller 24 and the roller guide 23.

Next, an image recording operation of the ink-jet printer 1 structured as above will be explained.

At first, the sheet feed roller 15 comes into contact with the uppermost sheet P1 of the sheets P stacked on the sheet feed cassette 10 owing to the weight of the roller 15 itself and the downward rotative motion of the arm 14. In this state, the sheets P are fed if the sheet feed roller 15 rotates. Then, only the uppermost sheet P1 is separated by the separation board 19 (due to inclined plane separation), and the separated sheet P1 is then transported to the roller guide 23 while being in contact with the separation board 19.

The uppermost sheet P1 enters the sheet transportation path R and is then guided to a nipped portion between the transportation roller 9 and a pinch roller 12 by the rotation of the U-turn roller 24. The sheet P1 is further transported to a platen 25 provided on the recording position opposite to the recording head 3 in a state that the sheet P1 is being nipped between the transportation roller 9 and the pinch roller 12.

Next, for the sheet P1 transported to the platen 25 as above, the recording operation by the recording head 3 mounted on the carrier 2 is started. If the recording operation for one scan by the recording head 3 ends, the recording operation is once interrupted, and the sheet P1 on the platen 25 is transported for a predetermined amount by the transportation roller 9. Then, a recording operation for next one scan is performed while moving again the carrier 2 along the guide shaft 7. After sequentially performing the recording operations by the recording head 3 on the platen 25 as above, the sheet is discharged on a cassette cover 13 by a sheet discharge roller 11*a* and a sheet discharge spur 11*b*.

In FIG. 1, numeral 11 denotes a head recovery means. The head recovery means 11 is provided at the position which becomes opposite to the recording head 3 when the carrier 2 moves to a home position provided in the vicinity of one end of the moving range of the carrier 2. The head recovery means 11 is operated in a recording standby state, before/after the recording operation, or in an interval between successive one-line recording operations, so as to perform various operations such as capping, suction, wiping and the like to the recording head 3, whereby clogginess or the like of the recording head 3 is prevented, and thus the performance of the recording head 3 is maintained.

Incidentally, while the sheets P are in contact with the separation board 19 by the rotation of the sheet feed roller 15, the sheets P receive the resistance of the separation board 19 not a little until the contact is released. For this reason, it is desirable to form the separation board 19 by using a sheet metal material such as an SUS (Steel Use Stainless) board or the like of which the friction resistance is low and the surface roughness is steady.

Figure 4:
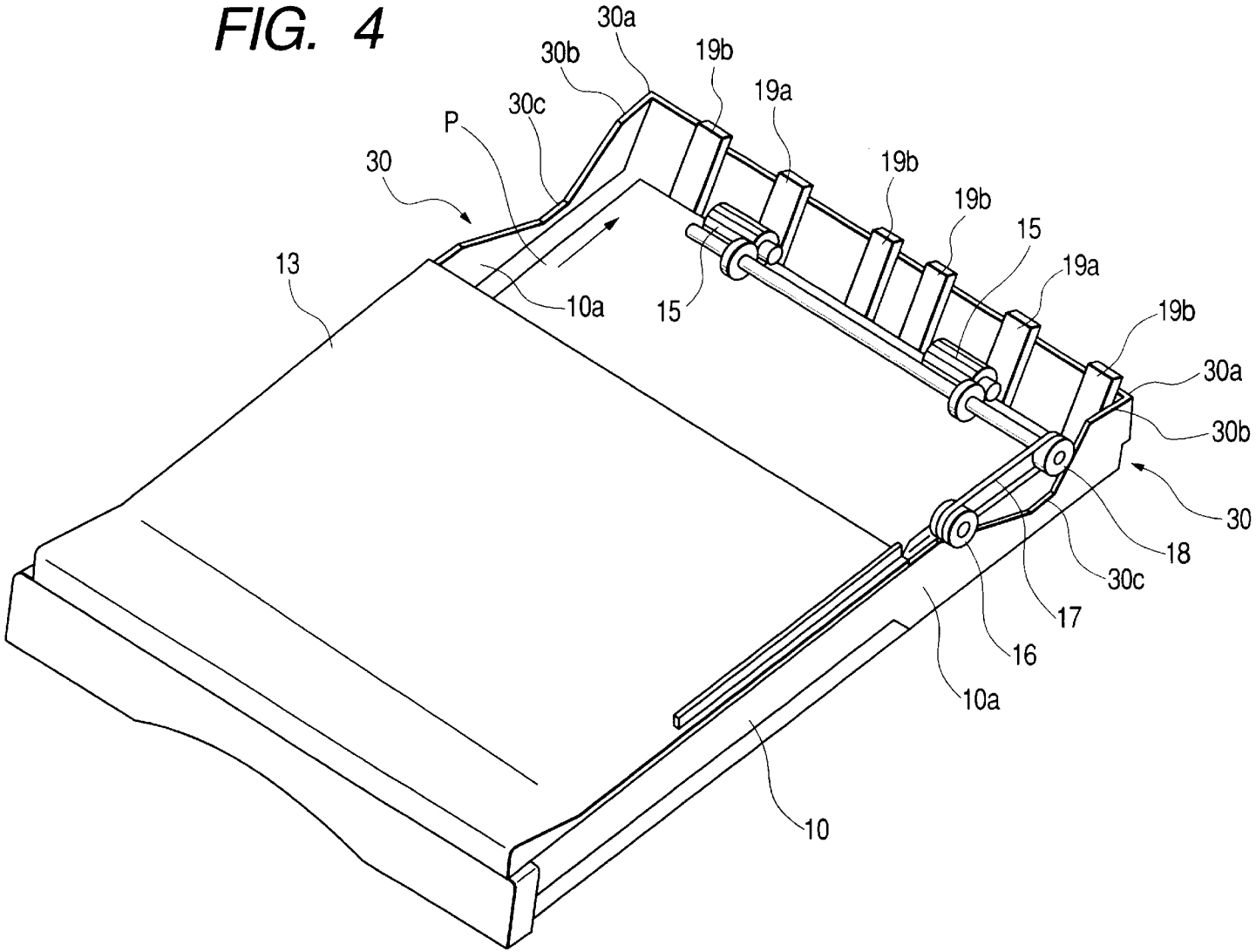
FIG. 4 is a perspective view showing the structure of the cassette of the sheet feed apparatus.

In the present embodiment, the plural separation boards 19 are provided at the positions corresponding to the sizes of the sheets P to be fed, whereby the sheets P of different sizes can be surely separated. Further, as shown in FIG. 4, in these separation boards 19, the separation boards (called first separation boards hereinafter) 19*a* corresponding to the sheet feed roller 15 are made lower in height as compared with the other separation boards (called second separation boards hereinafter) 19*b* so that the first separation boards 19*a* do not come into contact with the sheet feed roller 15 when the cassette 10 is installed in and released from the main body 1A.

As above, by setting the first separation boards 19*a* to have the height so that these boards do not come into contact with the sheet feed roller 15, it is possible to prevent that the sheet feed cassette 10 and the sheet feed roller 15 are not damaged when the cassette 10 is installed in and released from the main body 1A.

Further, by setting the first separation boards 19*a* to have the height so that these boards do not come into contact with the sheet feed roller 15, the limitation of the height of the second separation boards 19*b* can be revoked. Thus, the height of the second separation boards 19*b* can be set so that, even if the lots of the sheets P are stacked on the sheet feed cassette 10, the sheet P fed by the sheet feed roller 15 can enter and pass the sheet transportation path R as it changes the direction upward.

On the other hand, a guide unit 30 is provided at the end of the sheet feed direction along each side wall 10*a* of the sheet feed cassette 10. When the sheet feed cassette 10 is installed, the guide unit 30 acts as a movement unit which moves through the arm 14 the sheet feed roller 15 to the position where the roller 15 does not come into contact with the first separation boards 19*a* and then moves the roller 15 to the position where the roller 15 comes into contact with the uppermost surface of the sheet P. Further, by the guide unit 30, the sheet feed roller 15 is moved to the position where the roller 15 does not come into contact with the first separation boards 19*a* also when the sheet feed cassette 10 is drawn out.

The guide unit 30 is equipped with an end contact unit 30*a* which comes into contact with the arm 14 and turns the arm 14 upward when the sheet feed cassette 10 is installed, a holding surface 30*b* which underprops the arm 14 turned upward to maintain the state that the arm 14 is being turned upward, and a recess 30*c* which turns the arm 14 downward so that the sheet feed roller 15 comes into contact with the sheet P.

Next, operations to install and release the above-structured sheet feed cassette 10 to and from the main body 1A will be explained.

First, the installing operation of the sheet feed cassette 10 will be explained.

Figure 5:
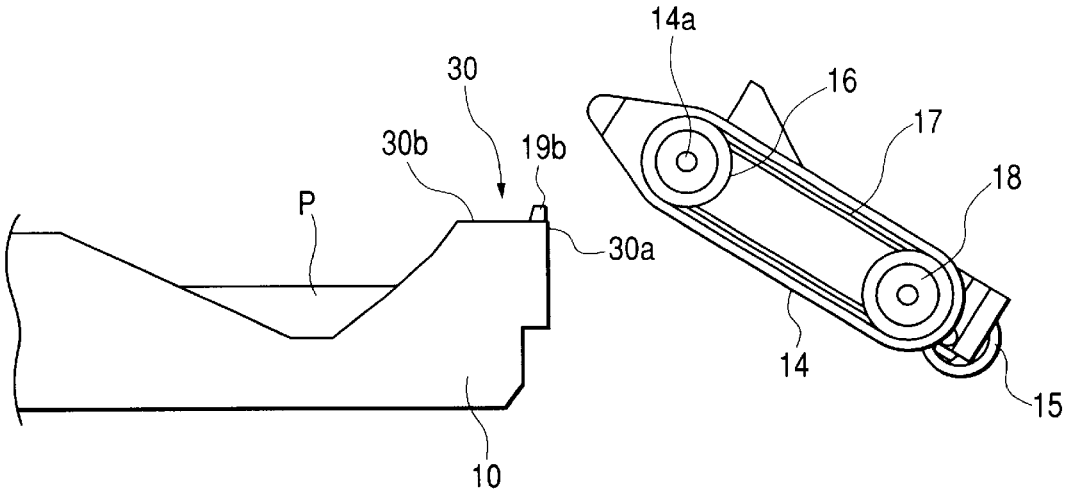
FIG. 5 is a diagram showing a state before the sheet feed cassette comes into contact with an arm.

The sheet feed cassette 10 is installed by inserting the cassette 10 into the main body 1A. Before the inserted sheet feed cassette 10 comes into contact with the arm 14, as shown in FIG. 5, the arm 14 is at the lower position due to its weight together with the sheet feed roller 15. At this time, the arm 14 is held by a not-shown stopper so that the arm must not descend more than the necessity.

Figure 6:
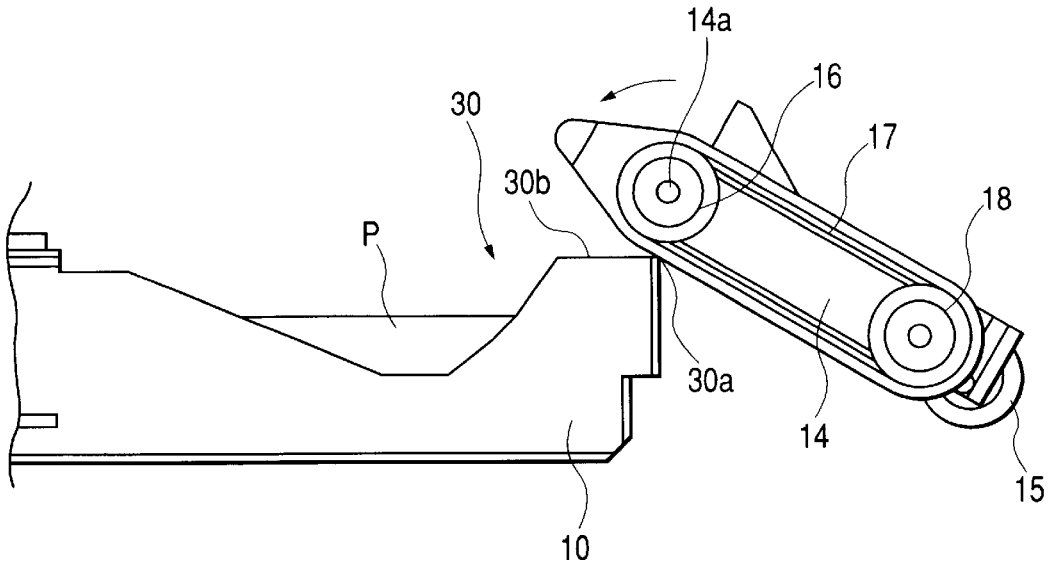
FIG. 6 is a diagram showing a state when the leading edge of the sheet feed cassette comes into contact with the arm.

Then, if the sheet feed cassette 10 on which the sheets P have been stacked is inserted into the apparatus side, as shown in FIG. 6, the end contact unit 30*a* of the guide unit 30 of the sheet feed cassette 10 comes into contact with the arm 14, whereby the arm 14 turns around the fulcrum shaft 14*a* in the direction indicated by the arrow.

Figure 7:
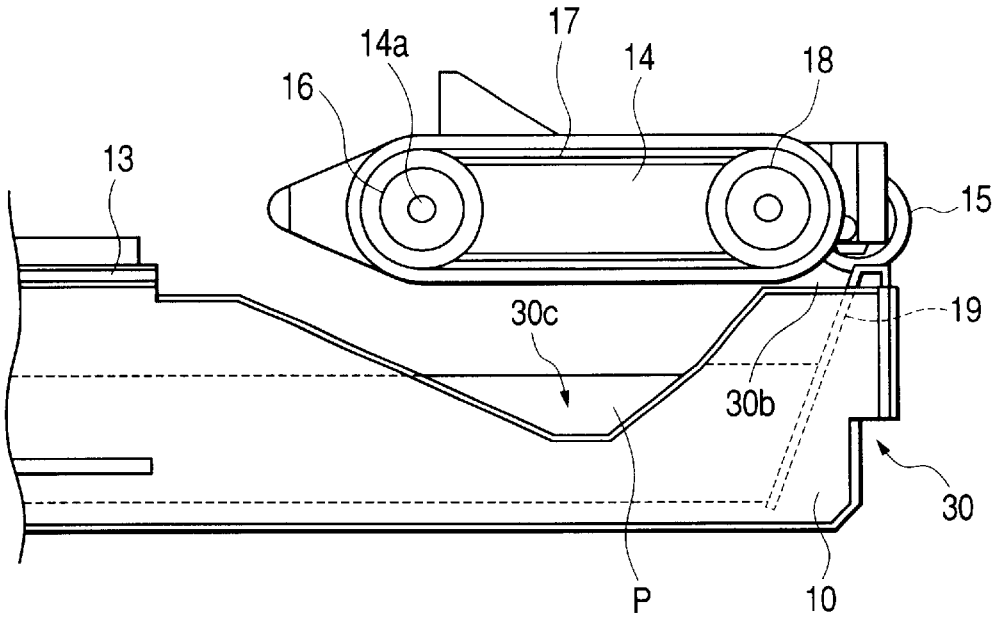
FIG. 7 is a diagram showing a state that the arm is bore by the sheet feed cassette.

Next, as shown in FIG. 7, the arm 14 is underpropped by the holding surface 30*b* of the guide unit 30 and thus maintained to be turned upward. The arm 14 then reaches the recess 30*c* if the sheet feed cassette 10 is further entered, and thereafter the arm 14 descends along the recess 30*c*.

Figure 8:
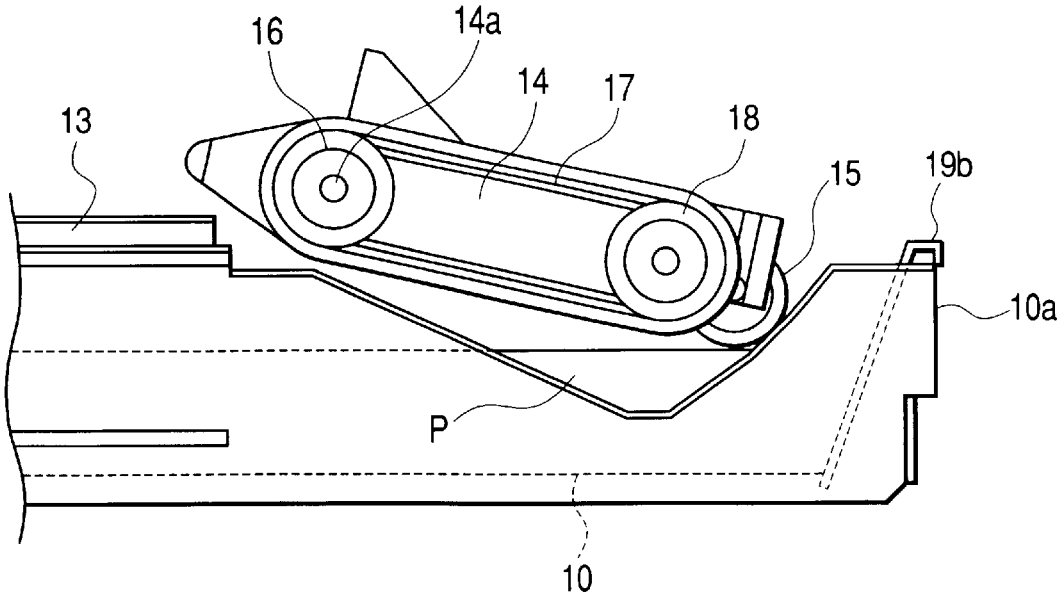
FIG. 8 is a diagram showing a state when the sheet feed cassette is installed.

Incidentally, the recess 30*c* of the guide unit 30 has the inclined plane of the angle by which the arm 14 smoothly descends as above and ascends when the sheet feed cassette 10 is drawn out (later described). If the arm 14 descends like this, as shown in FIG. 8, the sheet feed roller 15 comes into contact with the uppermost surface of the sheets P stacked on the sheet feed cassette 10.

Here, when the sheet feed cassette 10 is entered like this, since the first separation board 19*a* is lower than the second separation board 19*b*, the sheet feed roller 15 never comes into contact with the first separation boards 19*a*.

Further, in the case where the sheets P are fed by the sheet feed roller 15 after the sheet feed cassette 10 was installed as above, the second separation boards 19*b* have the height such that the sheet P fed by the sheet feed roller 15 can enter the sheet transportation path R as it changes the direction upward even if the lots of the sheets P are stacked on the sheet feed cassette 10, whereby the sheet P does not come into contact with the roller guide 23 at a sharp angle. Thus, it is possible to prevent that the sheet can not be fed, and the edge of the sheet is folded.

Next, the releasing operation of the sheet feed cassette 10 will be explained.

Figure 9:
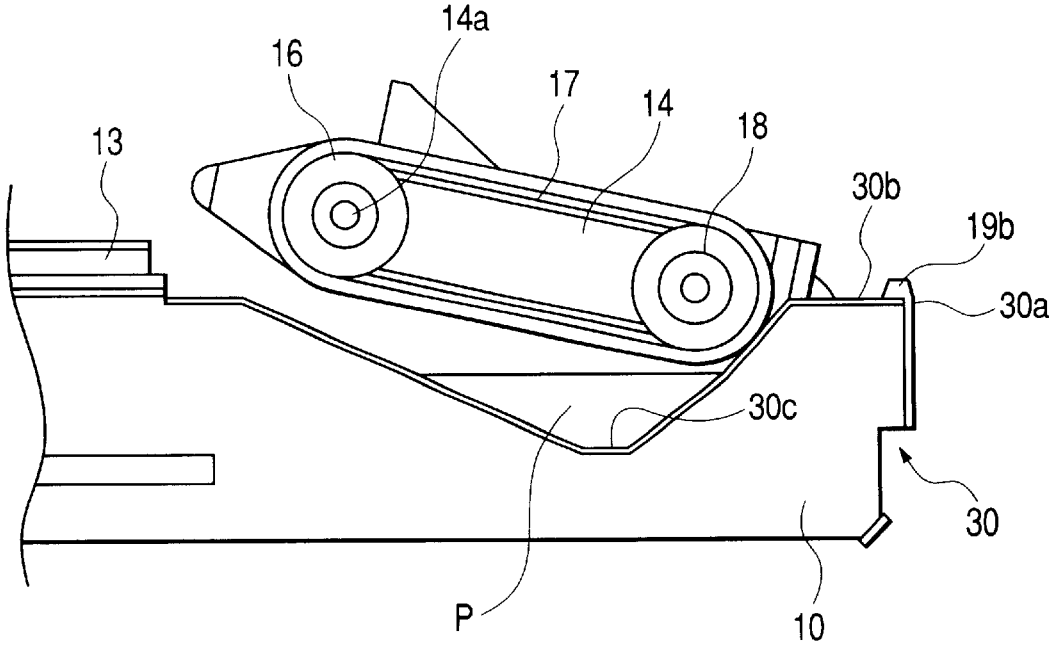
FIG. 9 is a diagram showing a state when the sheet feed cassette begins to be drawn out.

When the sheet feed cassette 10 is released, the cassette 10 is first drawn out to this side of the main body. If the cassette 10 is drawn out like this, as shown in FIG. 9, the arm 14 turns upward along the inclined plane of the recess 30*c* of the guide unit 30.

After then, if the cassette 10 is further drawn out, the arm 14 is underpropped by the holding surface 30*b* and thus maintained to be turned upward like FIG. 7. If the end contact unit 30*a* of the guide unit 30 reaches the arm 14, the arm 14 turns downward around the fulcrum shaft 14*a*.

When the sheet feed cassette 10 is released like this, since the first separation board 19*a* is lower than the second separation board 19*b*, the sheet feed roller 15 never comes into contact with the first separation boards 19*a*.

Although the separation boards 19 are provided at the positions necessary for sheet separation in the above explanation, the present invention is not limited to this, that is, the first and second separation boards 19*a* and 19*b* may be integrally provided.

Second Embodiment

Figure 10:
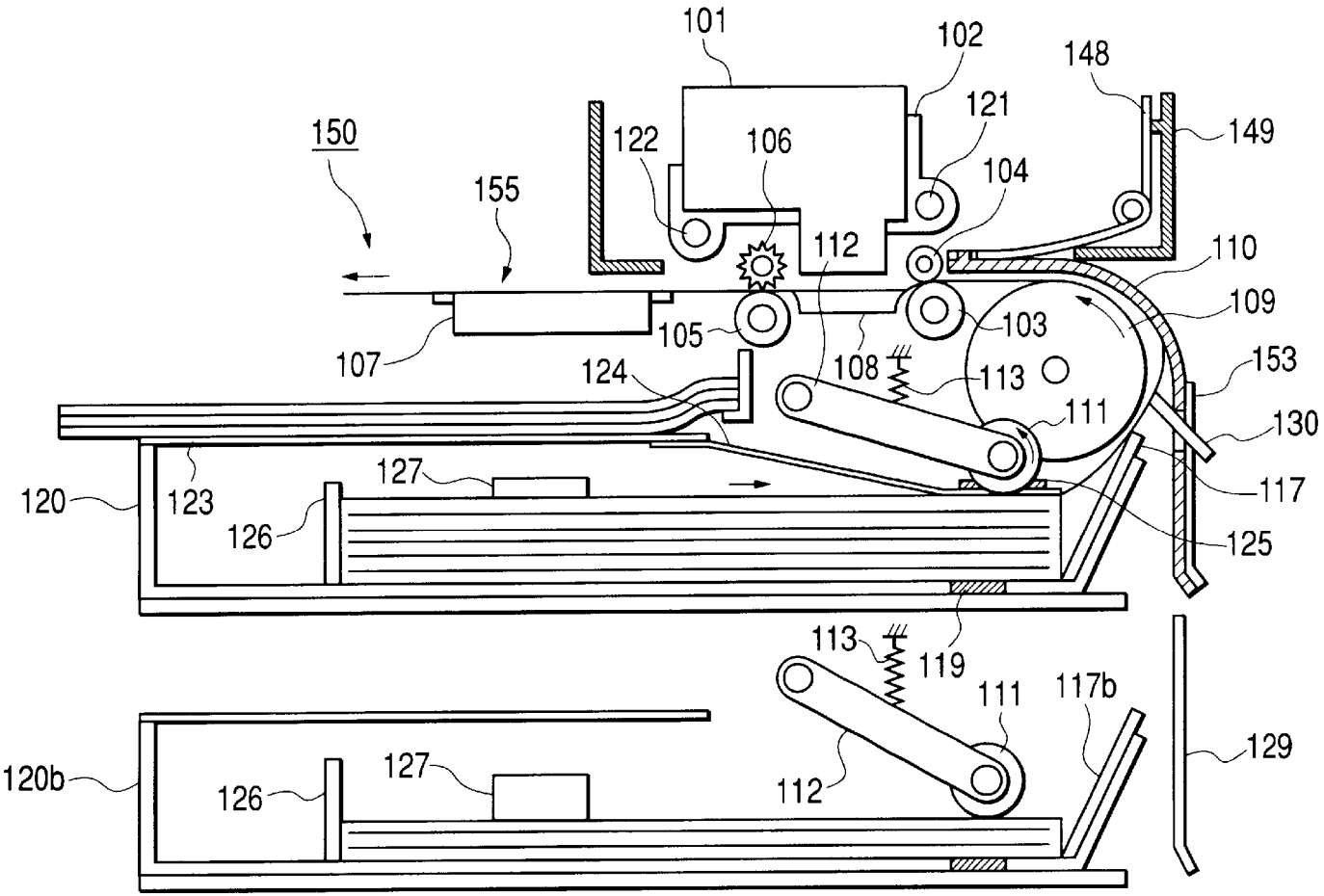
FIG. 10 is a sectional view showing an ink-jet printer according to the second embodiment of the present invention.

FIG. 10 is a sectional view showing an ink-jet printer being an example of a recording apparatus equipped with a sheet feed apparatus according to the second embodiment of the present invention.

An ink-jet printer 150 reverses a sheet P separated one by one and fed from a sheet feed cassette 120 by a sheet turnabout path (i.e., changes the direction of sheet P), transports the sheet P to the position opposite to a recording head 101, records an image on the sheet P by the recording head 101, and then discharges the sheet P on which the image has been recorded onto a cassette cover 123. Incidentally, it should be noted that the sheet P includes a plain sheet, a thick sheet, a resin sheet and the like.

First, the entire structure and the operation of the ink-jet printer 150 will be schematically explained.

The sheet feed cassette 120 stacks thereon the sheets P. A swing arm 112 turns upward and downward to cause a sheet feed roller 111 rotatably disposed at the end of the arm 112 to come into contact with the uppermost sheet P on the sheet feed cassette 120. In FIG. 10, the swing arm 112 and the sheet feed roller 111 overlap each other.

The swing arm 112 reduces applying force by a spring 113 to make the load applied to the sheet feed roller 111 appropriate. That is, the sheet feed roller 111 comes into contact with the sheets P stacked on the sheet feed cassette 120 with the force lighter than its own weight, and rotates along the direction indicated by the arrow to feed the sheet P from the sheet feed cassette 120 toward the downstream side. The sheet feed roller 112 also feeds a sheet manually set by a user from the cassette cover 123 toward the downstream side.

A separation board 117 is provided at the end of the downstream side of the sheet feed cassette 120 so that the upper edge thereof is inclined toward the downstream side of the sheet transportation direction rather than the lower edge thereof, whereby the separation board 117 ascendingly guides the sheet P fed by the sheet feed roller 111. When the plural sheets P overlap, the separation board 117 separates the sheets P one by one as ascendingly guiding them, whereby the separated sheet P is transported to a reversal roller 109 disposed on the sheet turnabout path.

A separation pad 119 is provided to separate the sheet P, and a trailing edge guide 126 is provided to flush the sheets stacked on the sheet feed cassette 120. A side guide 127 is provided to align the sheets P in the width direction (i.e., the direction intersecting the transportation direction of the sheet P) by pushing the sheets stacked on the sheet feed cassette 120 against the side wall of the cassette 120. A second sheet feed cassette 120*b* is disposed below the sheet feed cassette 120. The reversal roller 109 transports the sheet P fed from the sheet feed cassette 120 toward an image recording unit, a roller guide 110 guides the sheet P together with the reversal roller 109, and a PE (page end) sensor 130 detects the leading and trailing edges of the transported sheet P.

A carriage 102 is equipped with the recording head (recording means) 101 and reciprocated along carriage shafts 121 and 122. A transportation roller 103 and a pinch roller 104 which rotates according to the transportation roller 103 nip and transport the sheet P. A platen 108 supports the sheet P to be in parallel with the recording head 101. A sheet discharge roller 105 and a spur (or pinch roller) 106 which rotates according to the roller 105 nip and discharge the sheet P.

A flapper 107 of a sheet discharge unit 155 horizontally maintains the sheet P during the recording, and discharges the sheet P onto the cassette cover 123 after the recording. The cassette cover 123 also functions as the cover of the sheet feed cassette 120.

In the state that the sheet on which the image has been recorded is not put, the cassette cover 123 functions as a manual feed tray. A manual feed guide 124, which is provided at the end of the downstream side of the cassette cover 123, guides the manually fed sheet to the sheet feed roller 111. The manual feed guide 124 is formed by a flexible thin-thickness resin sheet to not become obstructive when the sheet P is discharged onto the cassette cover 123 and to guide the manually fed sheet to the sheet feed roller 111 regardless of the number of sheets stacked on the sheet feed cassette 120. A separation pad 125 is provided at the end of the manual feed guide 124, whereby the sheet separation can be surely performed to the last sheet even if the plural sheets are stacked on the manual feed guide 124.

Next, the operation of the ink-jet printer 150 will be explained. In FIG. 10, the sheet feed roller 111 rotates along the direction indicated by the arrow by a sheet feed motor 131 to feed the sheets P stacked on the sheet feed cassette 120 in the direction indicated by the arrow.

Figure 11:
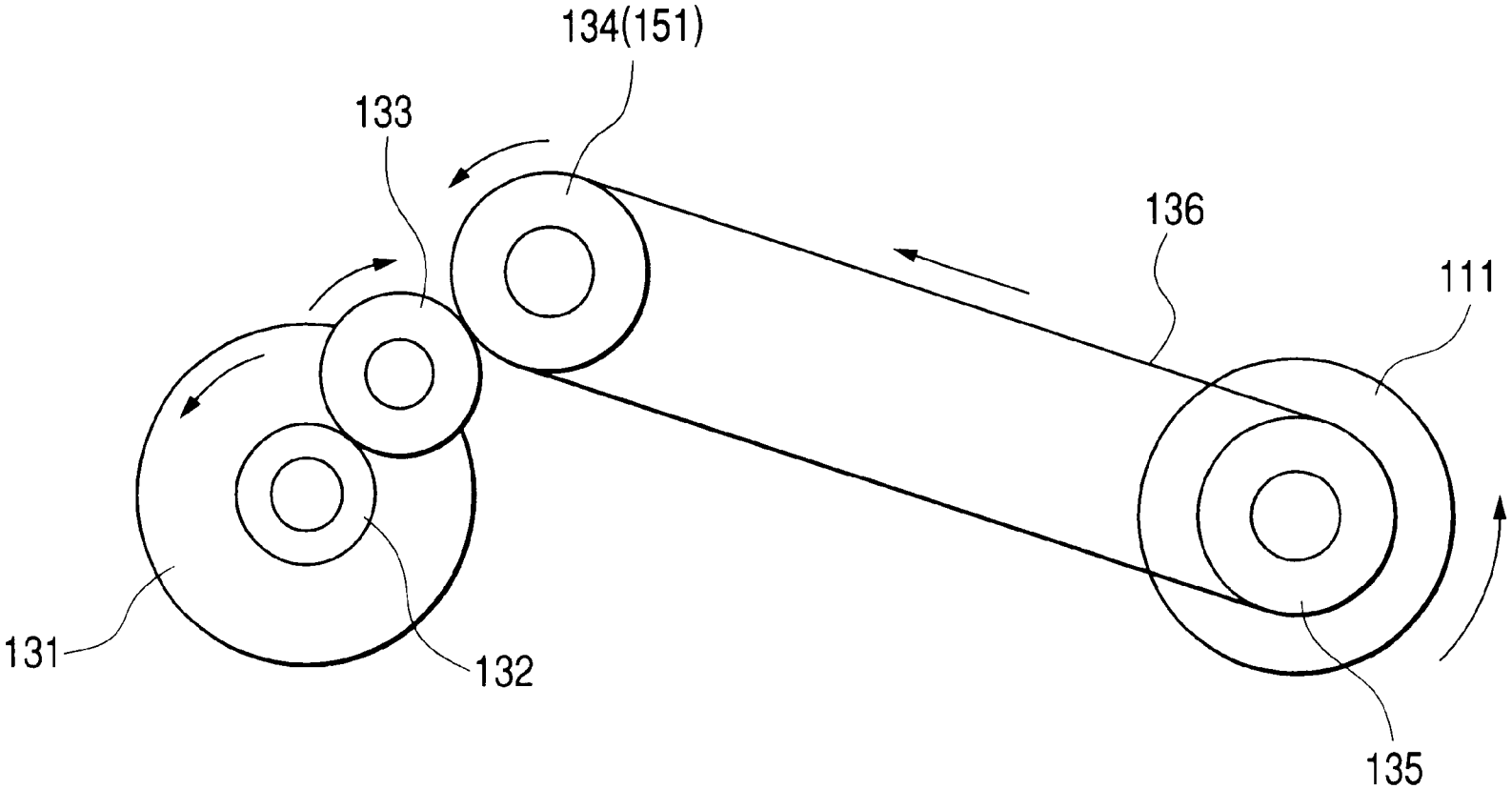
FIG. 11 is a diagram for explaining a driving system of a sheet feed roller.

In FIG. 11, the sheet feed motor 131 rotates along the direction indicated by the arrow to rotate a swing arm gear 134 along the direction indicated by the arrow through a sheet feed motor gear 132 and an idler gear 133. The swing arm gear 134 and a pulley 151 having the diameter substantially the same as that of the swing arm gear 134 are integrally provided on the same shaft. Similarly, the sheet feed roller 111 and a sheet feed pulley 135 are integrally provided on the same shaft. The pulleys 151 and 135 are wound with a driving belt 136, whereby the rotation force of the swing arm gear 134 is transmitted to the sheet feed roller 111 by the pulleys 151 and 135 and the driving belt 136.

The sheets P stacked on the sheet feed cassette 120 are guided to the separation board 117 and then transported to the reversal roller 109 by the rotation of the sheet feed roller 111. The sheet feed roller 111 further rotates to transport the sheet P along the roller guide 110.

Figure 12:
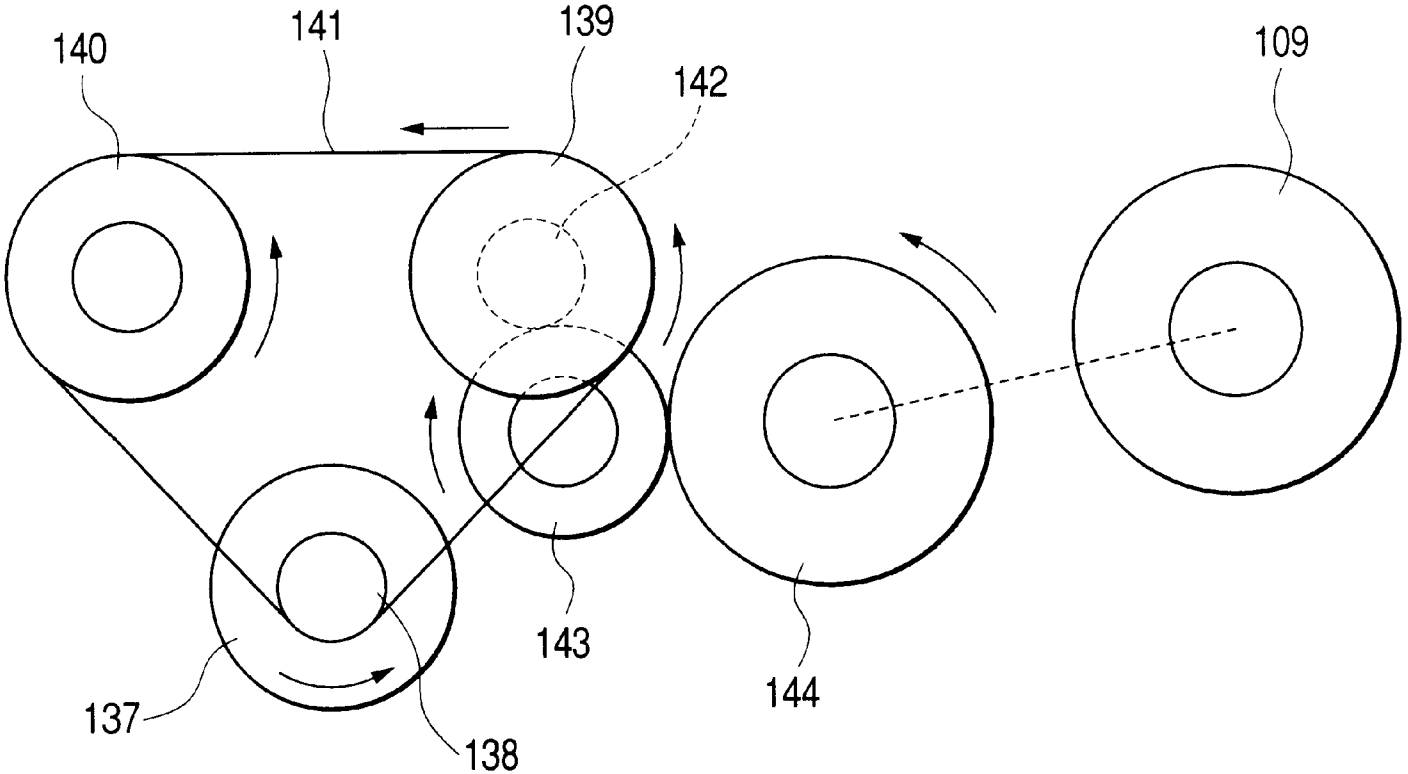
FIG. 12 is a diagram for explaining a driving system of a transportation roller, a sheet discharge roller and a reversal roller.

In FIG. 12, a transportation motor 137 rotates along the direction indicated by the arrow, and a transportation motor gear 138 is thus rotated along the same direction to rotate a driving belt 141 along the direction indicated by the arrow. The driving belt 141 is used to rotate a transportation pulley 139 provided on the same shaft as those of the transporting roller 103 and a transportation gear 142 and a sheet discharge pulley 140 provided on the same shaft as that of the sheet discharge roller 105 respectively along the directions indicated by the respective arrows, whereby the transportation gear 142 is rotated along the direction indicated by the arrow.

The transportation gear 142 rotates a one-way gear 143 along the direction indicated by the arrow to rotate a reversal roller gear provided on the same shaft as that of a reversal roller 144 along the direction indicated by the arrow. Here, the one-way gear 143 is structured to transmit the rotation force along the direction indicated by the arrow to the reversal roller gear but not transmit the rotation force along the opposite direction, so as to remove the sheet P wound around the reversal roller 109. That is, the sheet P wound around the reversal roller 109 can be drawn out from the nip between the sheet discharge roller 105 and the pinch roller 106. The reversal roller 109 is rotated by the force of drawing the sheet P from the side of the sheet discharge roller 105 by the user and the frictional force of a friction material such as the rubber of the reversal roller 109, whereby the sheet P wound around the reversal roller 109 can be removed.

In FIG. 10, if the sheet feed roller 111 is rotated by the sheet feed motor 131, at the same time, the transportation roller 103 and the reversal roller 109 are rotated by the transportation motor 137. Thus, since the leading edge of the transported sheet P is detected by the PE sensor 130, the transportation position of the sheet P is obtained. The sheet P of which the leading edge has been detected is further transported by the rotation of the sheet feed roller 111, and the sheet P is reversed as it passes the clearance between the roller guide 110 and the reversal roller 109, whereby the recording surface of the sheet P becomes faceup.

A reversal roller rubber of which the frictional coefficient for the sheet P is high is provided on the reversal roller 109. If the sheet P is a tough sheet such as a thick sheet or the like, this sheet P is transported by the transportation force generated when the sheet P is partially pushed against the reversal roller rubber by the toughness of the sheet itself.

If the sheet P which passed the PE sensor 130 is transported to the vicinity of the transportation roller 103 by the sheet feed roller 111, the transportation motor 137 stops rotating, and the transportation roller 103 and the reversal roller 109 also stop rotating. After then, if the sheet feed roller 111 rotates by a predetermined amount, the sheet P collides against the nip between the transportation roller 103 and the pinch roller 104, whereby obliqueness of the leading edge of the sheet P is corrected.

Further, as described above, the reversal roller 109 transmits the rotation only in the direction indicated by the arrow by the one-way gear 143 of transmitting the rotation only in one direction. For this reason, if it causes the tough sheet such as the thick sheet or the like to collide against the nip between the transportation roller 103 and the pinch roller 104 by the rotation of the sheet feed roller 111, the reversal roller 109 rotates without any load by the friction between the tough sheet and the reversal roller rubber, whereby the transportation force in case of transporting the tough sheet such as the thick sheet or the like need not be increased.

After transporting the sheet P by a predetermined amount by the transportation roller 103 and the pinch roller 104, the driving of the sheet feed roller 111 is stopped. It should be noted that the transportation amount of the reversal roller 109 is set to be slightly larger than that of the transportation roller 103. By the above structure, back tension does not occur on the sheet, and thus the image can be recorded in high accuracy.

The size of the sheet P which can be recorded by the ink-jet printer 150 in the present embodiment is the size by which the trailing edge of the sheet positions at the upstream side of the sheet feed roller 111 at this time. That is, the transportation distance from the nipped portion between the transportation roller 103 and the pinch roller 104 to the sheet feed roller 111 is set to be shorter than the length of the image-recordable sheet. For example, to be able to transport a postal card in its longitudinal direction and record an image thereon, the transportation distance from the transportation roller 103 to the sheet feed roller 111 is set to about 140 mm shorter than the longitudinal length 148 mm of the postal card. Besides, the diameter of the reversal roller 109 is set to about 40 mm to 50 mm which is the shortest size by which the postal card does not curl.

In FIG. 11, the sheet feed pulley 135 which has the one-way structure transmits the rotation indicated by the arrow to the sheet feed roller 111 but does not transmit the opposite rotation. In FIG. 10, after the rotation of the sheet feed roller 111 ended, the sheet P is transported by the rotation of the transportation roller 103. At this time, since the sheet feed roller 111 rotates along the direction indicated by the arrow substantially without any load by the pulley 135 of the one-way structure, the roller 111 is drawn by the sheet P and thus runs idle.

Since the center of the pinch roller 104 is disposed at the position slightly dislocated toward the downstream side from the center of the transportation roller 103, the sheet P is transported by the pinch roller 104 so that it is pushed toward the platen 108. Then, the recording head 101 of the carriage 102 is shifted along the carriage shafts 121 and 122, whereby the image is recorded on the sheet P. Since the transportation amount of the sheet discharge roller 105 is set to be slightly larger than the transportation amount of the transportation roller 103, the sheet P on the platen 108 does not loosen.

The sheet P on which the image has been recorded by the recording head 101 is transported as it is maintained horizontally by the flapper 107. The sheet P transported by the sheet discharge roller 105 and the spur 106 is discharged from the upper surface of the flapper 107 onto the cassette cover 123 by inclining the flapper 107. Thus, the recording operation of the ink-jet printer 150 completes.

The above explanation of the recording operation was applied to the case where the sheet P is fed from the upper sheet feed cassette 120. However, similarly, images are recorded respectively to the sheets stacked on the lower sheet feed cassette **120*b*, and these sheets are then discharged from the cassette 120*b*. Since the structure of the lower sheet feed cassette 120*b* is substantially the same as that of the upper sheet feed cassette 120**, only the different points will be explained.

The sheets P stacked on the lower sheet feed cassette **120*b* are separated one by one by the separation board 117, and then transported along a lower stage guide unit 129 and the roller guide 110. Thus, since the leading edge of the transported sheet P is detected by the PE sensor 130, the transportation position of the sheet P is obtained. After then, the image is recorded on the sheet P by the recording head 101**.

Like the upper sheet feed cassette 120, the size of the sheet P usable in the lower sheet feed cassette **120*b* is the size longer than the distance from the nipped portion between the transportation roller 103 and the pinch roller 104 to the sheet feed roller 111**.

Figure 13:
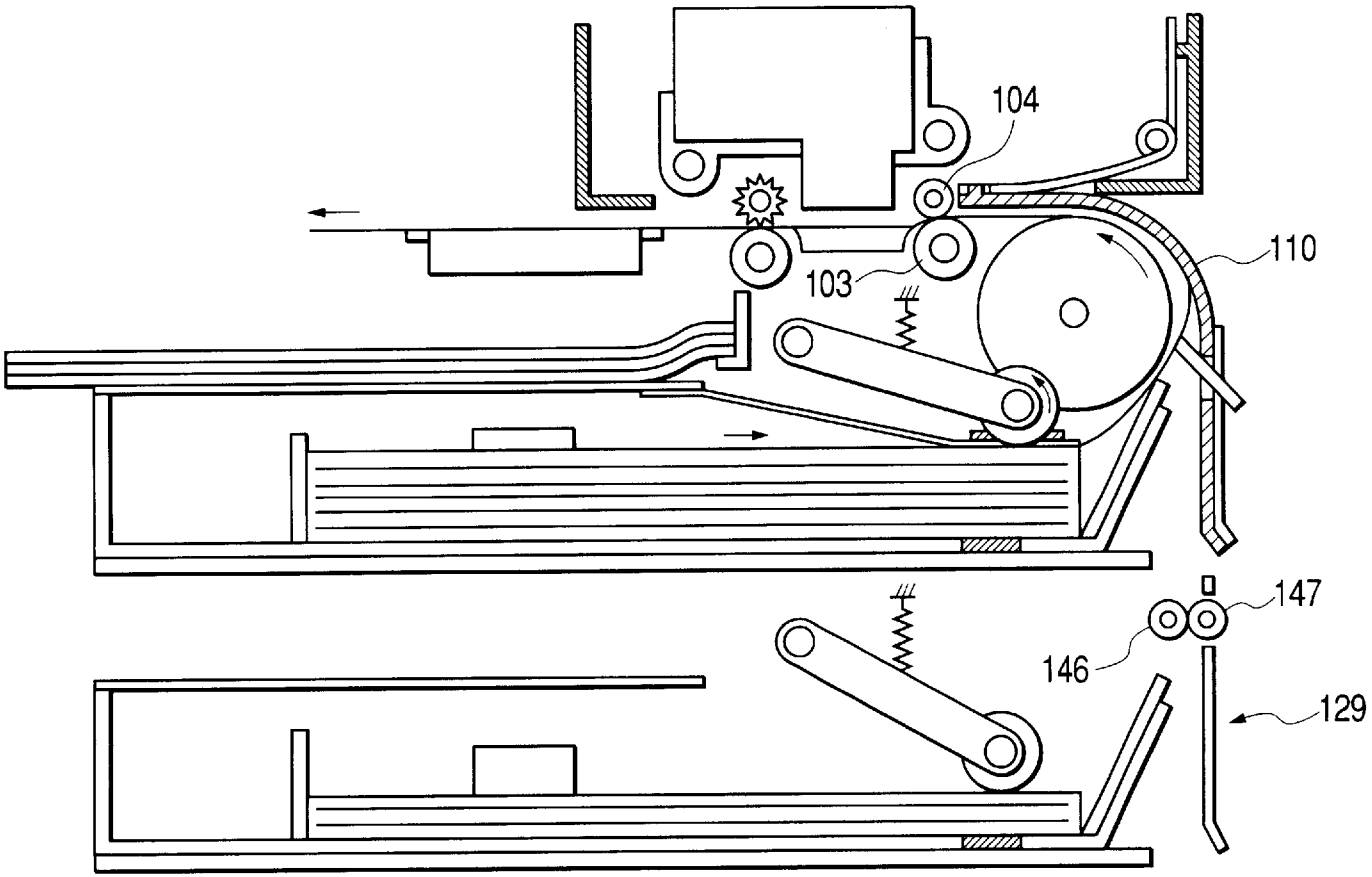
FIG. 13 is a sectional view showing an ink-jet printer which is equipped with an intermediate roller.

As shown in FIG. 13, an intermediate roller 146 and a dependent roller 147 are provided between the lower stage guide unit 129 and the roller guide 110, whereby the sheet P may be transported by rotating the intermediate roller 146 with a not-shown driving motor. In this case, the image-recordable sheet is the sheet of which the size is longer than the distance from the nipped portion between the transportation roller 103 and the pinch roller 104 to the intermediate roller 146. Further, plural lower sheet feed cassettes can be installed by providing the intermediate roller 146.

Next, the manual sheet feed will be explained. In FIG. 10, if a not-shown manual feed lever is operated, the swing arm 112 comes to be apart from the sheets stacked on the sheet feed cassette 120 in accordance with the operation of the manual feed lever, whereby the leading edge of the manually fed sheet can be set at the downstream side of the sheet feed roller 111. Here, the trailing edge position of the manually fed sheet has been marked for each sheet size on the cassette cover 123 so that the user can see the position at which the sheet to be manually fed should be set.

The sheet P to be manually fed is set on the upper surface of the manual feed guide 124. Here, even if the plural sheets P are set, these sheets are separated one by one by the separation pad 125 provided on the manual feed guide 124. After the manually fed sheet P was set on the upper surface of the manual feed guide 124, if the not-shown manual feed lever is returned to the former position, the swing arm 112 rotates toward the sheet in accordance with the operation of the manual feed lever. Since the set sheet P for the manual feed is added on the sheets P stacked on the sheet feed cassette 120, such the added sheet is fed according to the same operation as that for the sheets stacked on the sheet feed cassette 120. If all the set sheets for the manual feed are fed, then the sheets P stacked on the sheet feed cassette 120 are fed.

Figure 14:
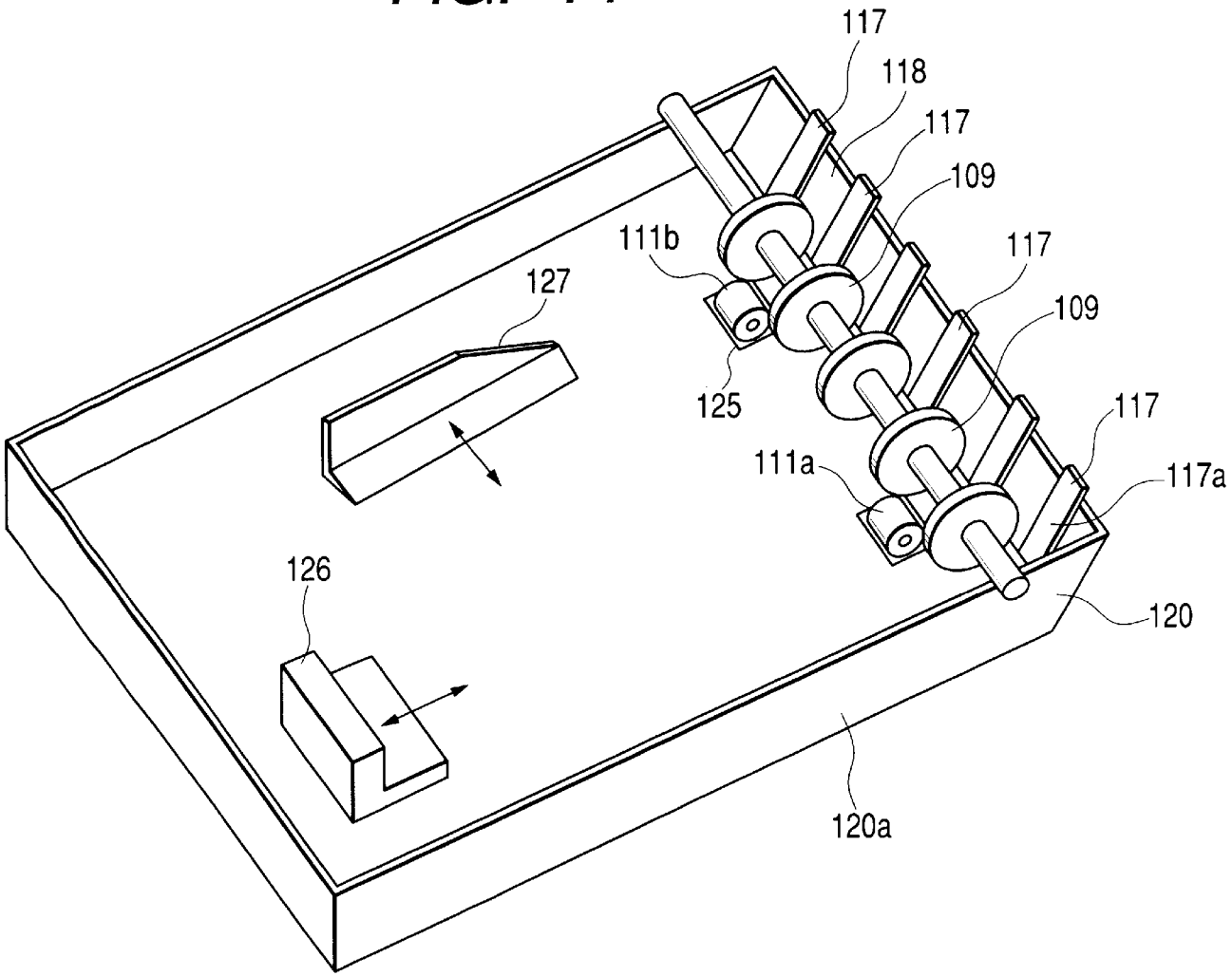
FIG. 14 is a perspective view showing the positional relation of a sheet feed cassette, sheet feed rollers and reversal rollers.
Figure 15:
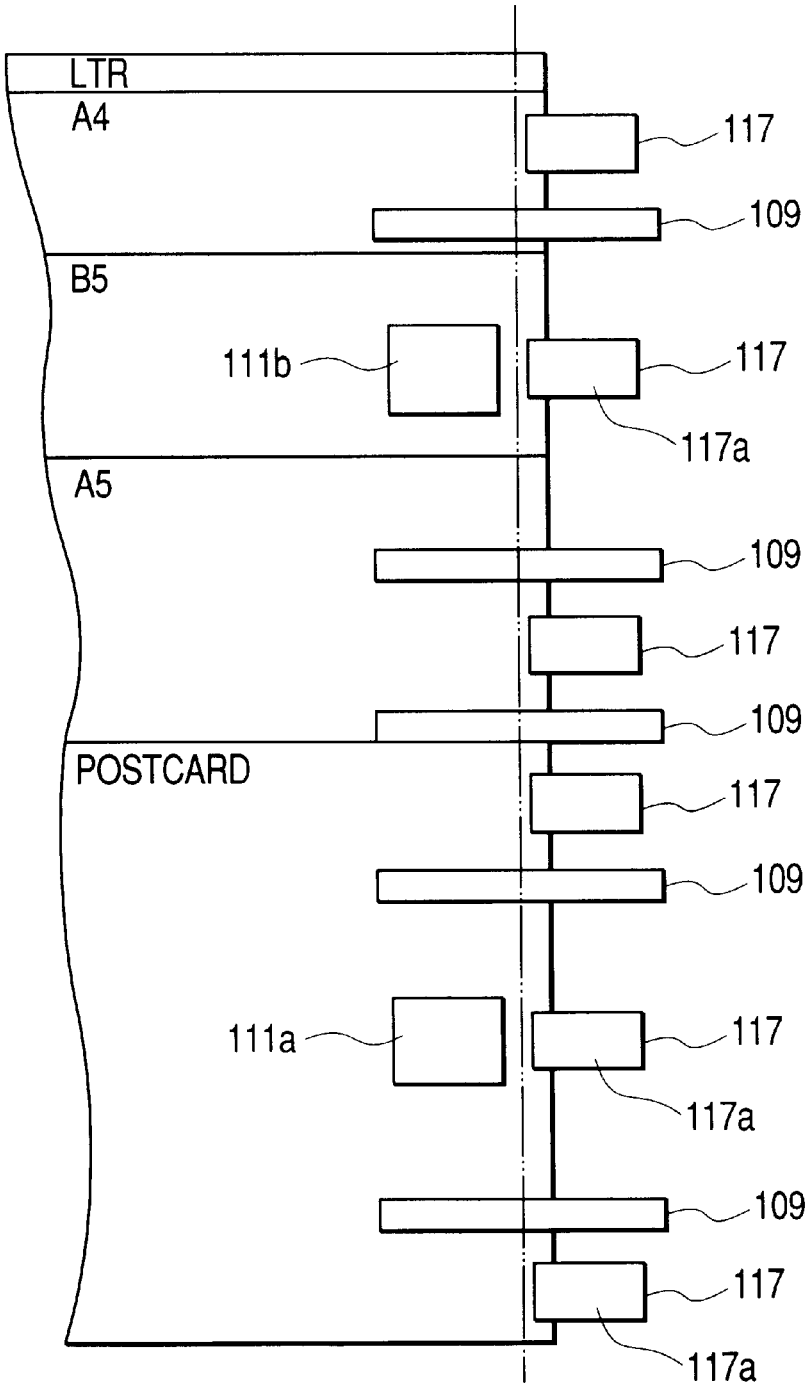
FIG. 15 is a plan view showing the positional relation of the sheet feed rollers, separation boards, the reversal rollers and sheets.

Next, FIG. 14 is a perspective view showing the positional relation of the sheet feed cassette 120, sheet feed rollers 111*a* and 111*b* and the reversal rollers 109. FIG. 15 is a plan view showing the positional relation of the sheet feed rollers 111*a* and 111*b*, the separation boards 117, the reversal rollers 109 and various-sized sheets.

The ink-jet printer 150 of the present embodiment is based on the one side edge along the width direction of the sheet for all the sheet stacking, the sheet transportation and the sheet discharging. Concretely, in the sectional view of FIG. 10, the ink-jet printer 150 is based on this side. In FIG. 14, the sheets are stacked on the sheet feed cassette 120 on the basis of a this-side side wall 120*a* of the cassette 120.

Each reversal roller 109 is disposed between the separation boards 117 in the sheet width direction, whereby the height of the sheet feed apparatus can be lowered, and thus the height of the ink-jet printer 150 can be lowered too.

The first sheet feed roller 111*a* disposed on the base side with respect to the sheet width direction is disposed at the position corresponding to the center of the shorter edge of a postal card set to be transported in its longitudinal direction, whereby even a small-sized sheet can be surely fed. On the other hand, the second sheet feed roller 111*b* is disposed at the position apart from the center of a B5-sized sheet by the distance equal to that of the position of the first sheet feed roller 111*a* from the center of the B5-sized sheet, whereby even a large-sized sheet can be surely fed. Besides, the separation boards 117 are disposed at the positions corresponding to the sheet feed rollers 111*a* and 111*b* in the sheet width direction. Thus, even if the sheet is warped by the reversal rollers 109 each disposed between the separation boards 117, it is possible to cause the sheet feed rollers 111*a* and 111*b* to come into contact with this sheet at the positions not warped, whereby the sheet can be surely fed. Further, the separation boards 117 are disposed also at the positions in the vicinities of both the edges of the sheet of each size, whereby the various kinds of sheets can be surely fed.

Moreover, the sheet feed roller 111 is disposed to partially overlap the reversal roller 109 in view of the sectional direction, whereby the height of the sheet feed apparatus can be lowered and also the sheets can be surely fed.

Figure 16:
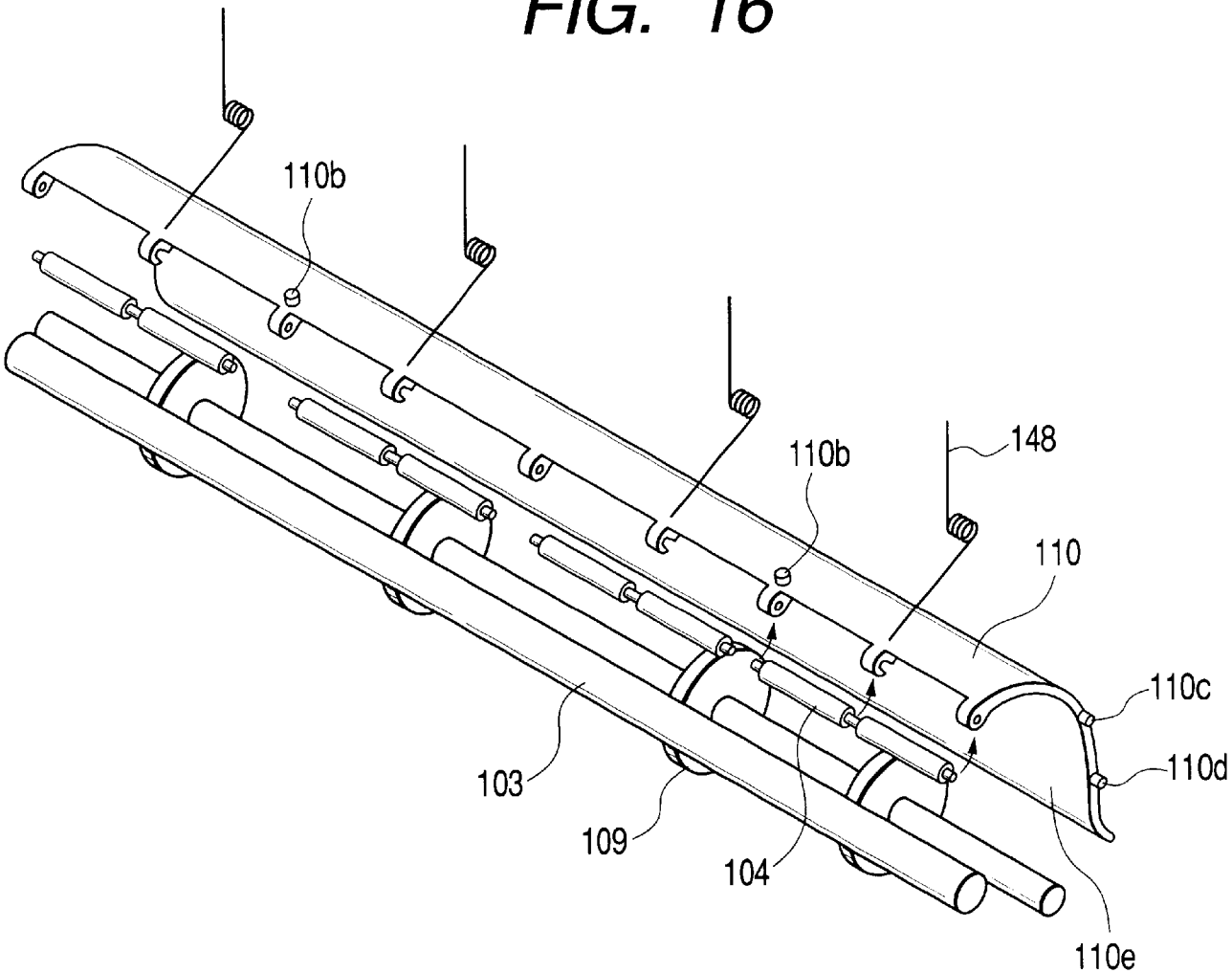
FIG. 16 is a perspective view showing the positional relation of the transportation roller, a pinch roller, the reversal roller and a roller guide.
Figure 17:
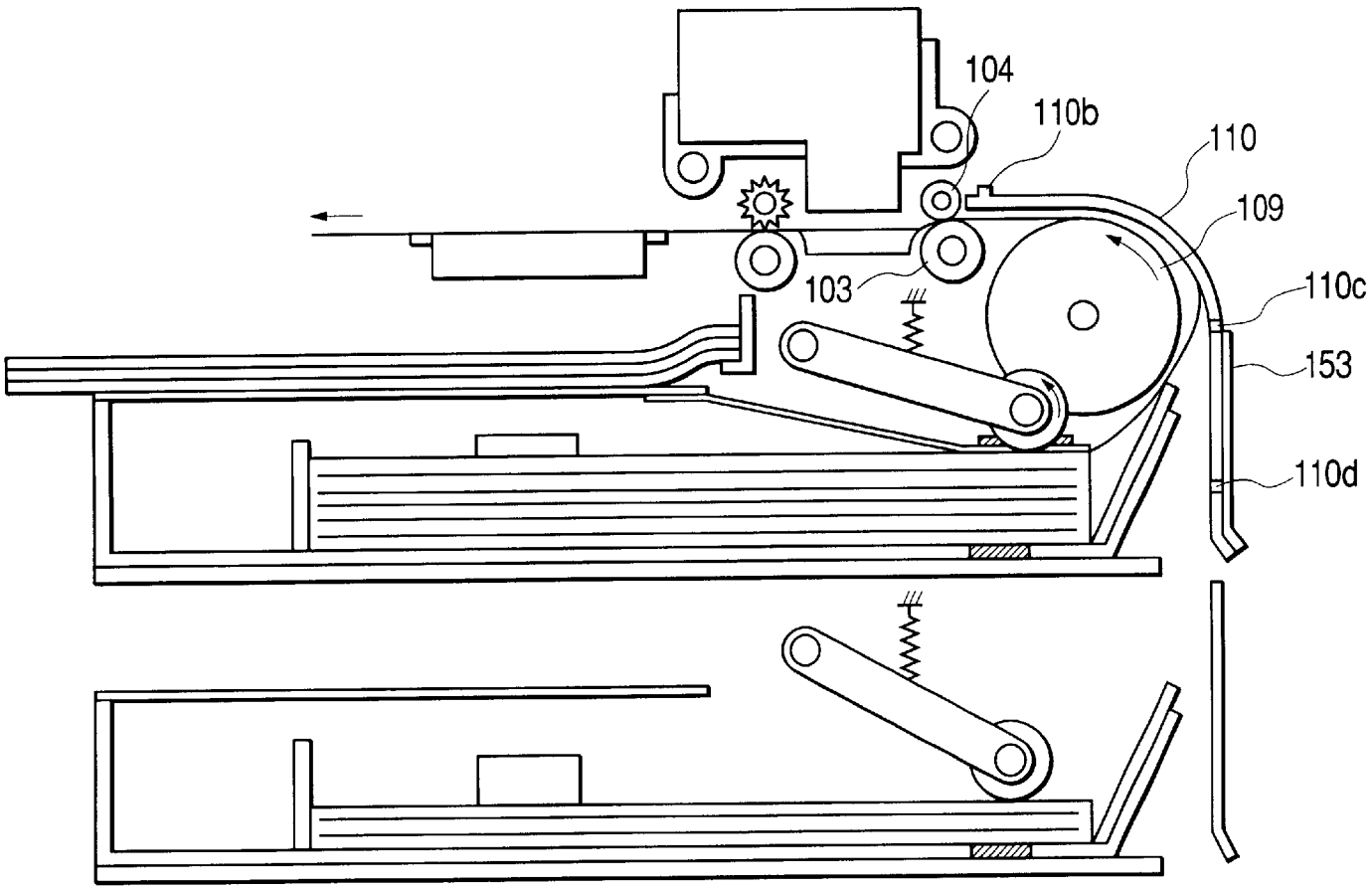
FIG. 17 is a sectional view of the ink-jet printer partially omitted to show the positioning portions of the roller guide.

FIG. 16 is a perspective view showing the positional relation of the transportation roller 103, the pinch roller 104, the reversal roller 109 and the roller guide 110. FIG. 17 is a sectional view of the ink-jet printer partially omitted to show the positioning portions of the roller guide 110.

As shown in FIGS. 16 and 17, the roller guide 110 has a bend 110*e* to reverse the sheet transportation direction, and the pinch roller 104 is set to the end of the downstream side of the bend 110*e* of the roller guide 110 and rotatably supported. As shown in FIG. 10, the bend 110*e* of the roller guide 110 is pushed to the side of the transportation roller 103 by a pinch roller spring 148 fixed to a carriage chassis 149 so that the pinch roller 104 comes into pressure-contact with the transportation roller 103. The bend 110*e* of the roller guide 110 has elasticity, whereby the bend 110*e* is elastically deformed by the spring force of the pinch roller spring 148.

Bosses 110*b* projected on the roller guide 110 are fitted into the holes on the carriage chassis 149 to position the pinch rollers 104 with respect to the transportation roller 103. There is a clearance between the boss 110*b* of the roller guide 110 and the carriage chassis 149, whereby the pinch roller 104 can shift upward when the sheet P enters the nipped portion between the transportation roller 103 and the pinch roller 104.

The roller guide 110 further has a boss 110*c* at the position of which the height is the same as that of the center of the reversal roller 109, and a boss 110*d* at the position lower than the position of the boss 110*c* and at the upstream end of the roller guide 110. The positioning bosses 110*c* and 110*d* are fitted into the holes on the side wall of the ink-jet printer 150 to position the roller guide 110 on the side wall. The center of curvature of the bend 110*e* approximately accords with the center of the reversal roller 109. That is, by providing the positioning boss 110*c* at the position of which the height is the same as the center of the reversal roller 109, the upper half of the roller guide 110 bends based on the positioning boss 110*c* even if the roller guide 110 is pushed by the pinch roller spring 148, whereby the interval between the reversal roller 109 and the roller guide 110 can be maintained almost constantly. If the positioning boss 110*c* is not provided, the roller guide 110 bends as a whole, whereby the interval between the reversal roller 109 and the roller guide 110 can not be maintained to a predetermined value.

The roller guide 110 is formed by a single member from its upstream end to the position where the pinch rollers 104 are disposed, whereby there is no seam inside the guide 110. Thus, the sheet is smoothly transported without being caught to the roller guide 110, whereby the sheet is never wounded. Although the roller guide 110 is formed by an elastic member, the upper half of the guide 110 is formed to easily bend while the lower half thereof is made a solid body not easily bending, whereby plural ribs 153 are provided on the outer surface of the lower half along the vertical direction.

Figure 18:
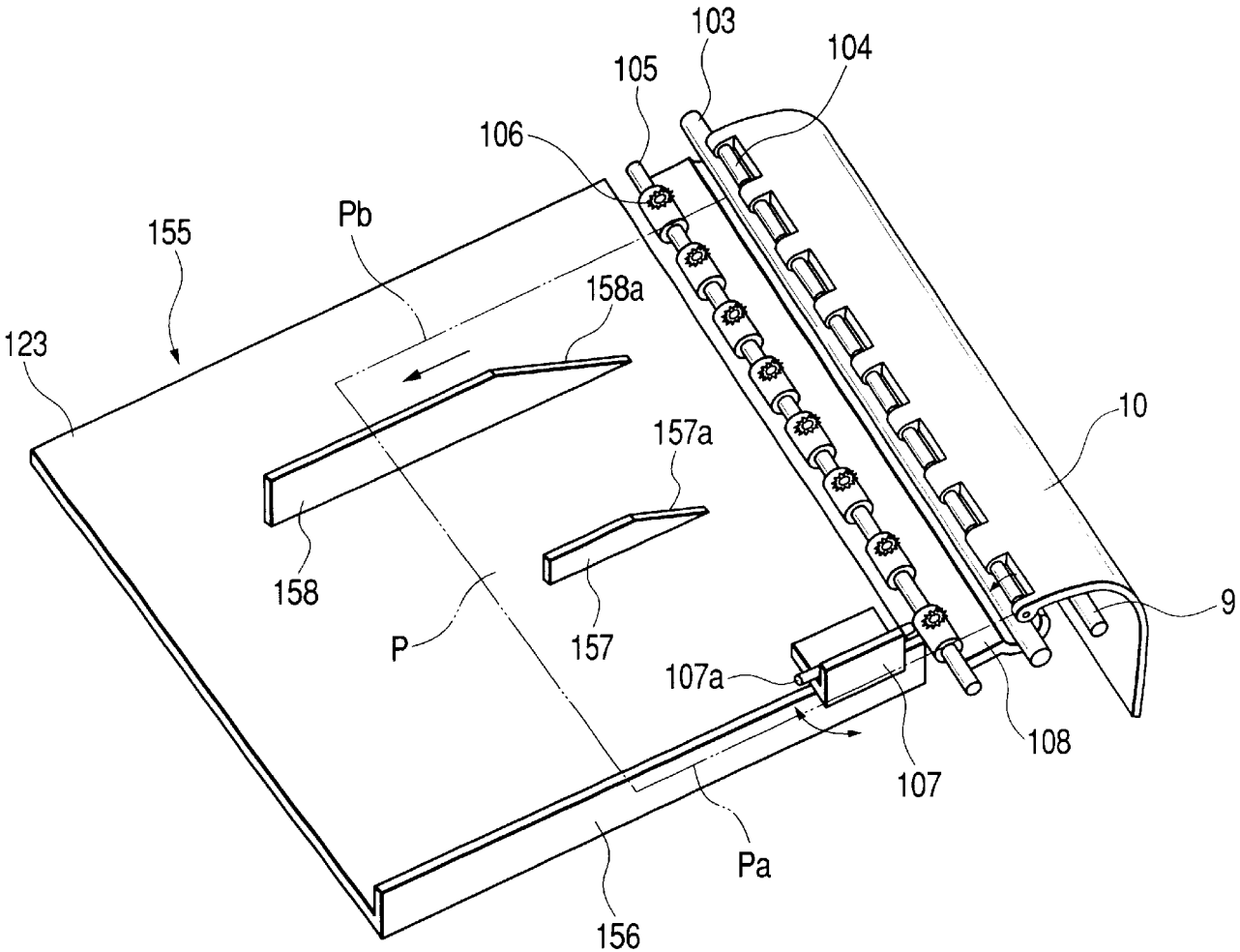
FIG. 18 is a perspective view showing the structure of a sheet discharge unit.
Figure 19:
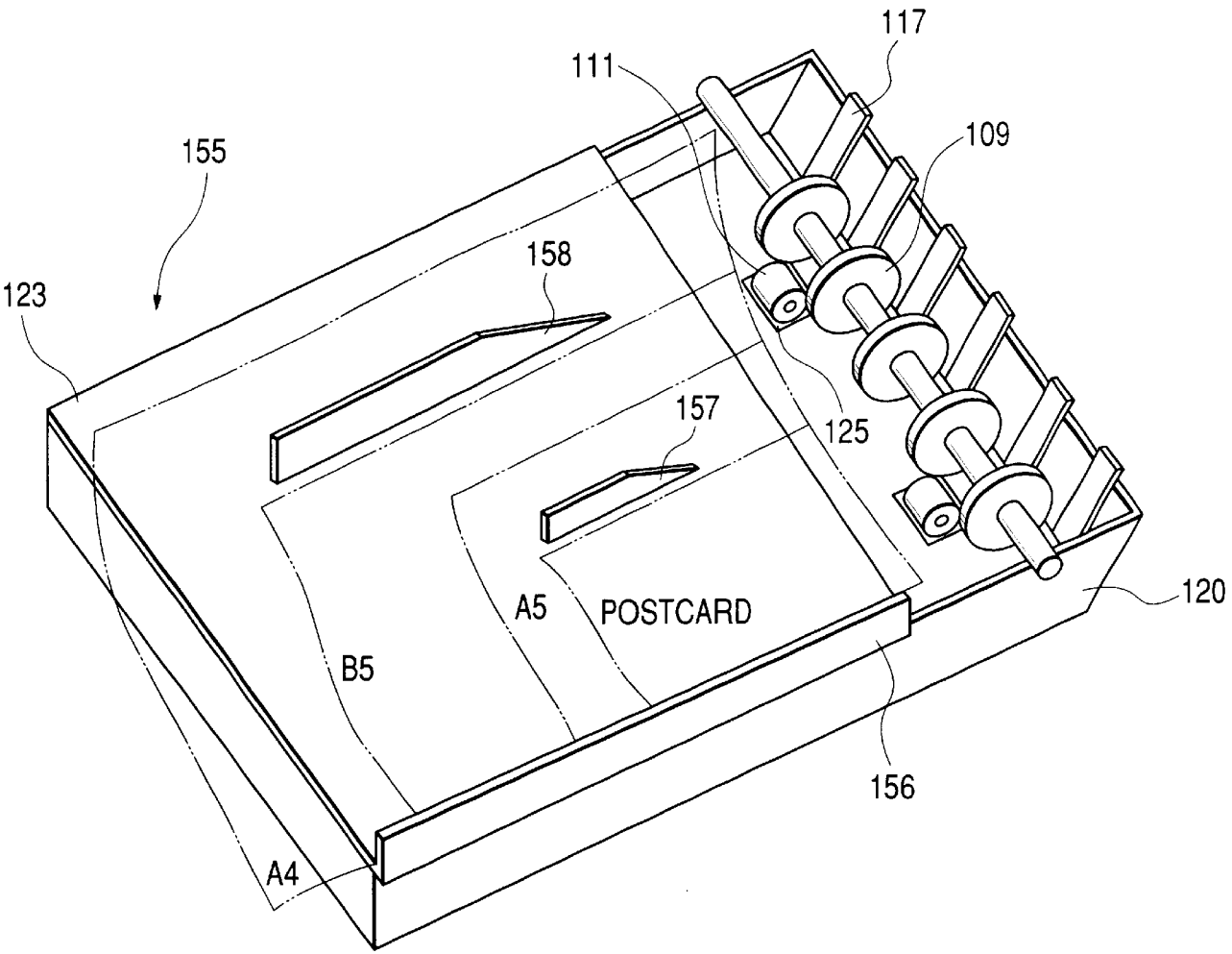
FIG. 19 is an outer perspective view showing a case where a cassette cover is overlaid on the sheet feed cassette.
Figure 20:
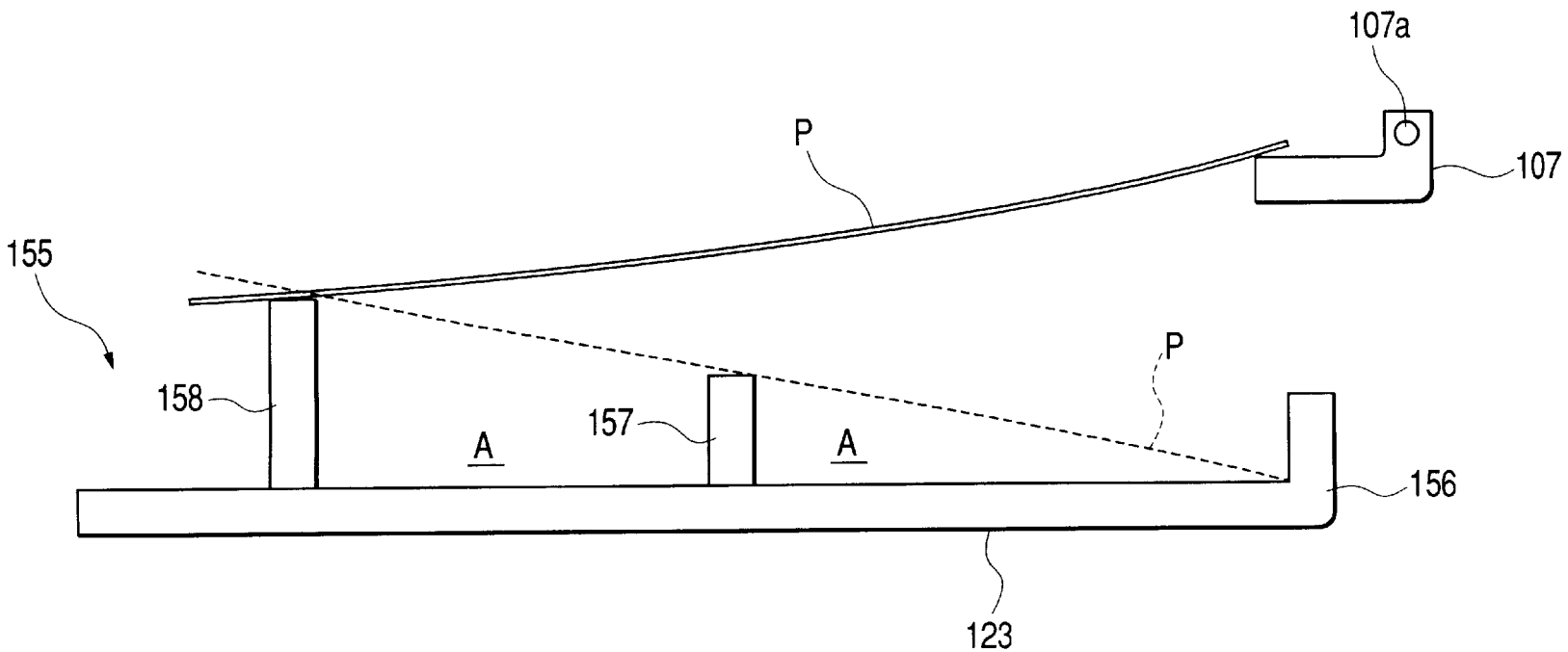
FIG. 20 is a front view showing the sheet discharge unit.

FIG. 18 is a perspective view showing the structure of a sheet discharge unit, FIG. 19 is an outer perspective view showing a case where the cassette cover is overlaid on the sheet feed cassette, and FIG. 20 is a front view showing the sheet discharge unit.

The sheet discharge unit transports the sheet on which the image has been recorded by using the sheet discharge roller 105 and the spur 106, drops the transported sheets by the flapper 107, align the side edges of the dropped sheets, and stacks the aligned sheets on the cassette cover 123. The flapper 107 holds a side edge Pa of the transported sheet P with respect to its width direction, and then releases the holding. As described above, the ink-jet printer 150 of the present embodiment is based on the one side edge along the sheet width direction for all the sheet stacking, the sheet transportation and the sheet discharging. The sheets are discharged and stacked on the cassette cover 123 on the basis of a this-side base wall 156 of the cover 123.

The flapper 107 which is disposed on the base side of the sheet is inclined upward and downward based on a pin 107*a* by driving of a not-shown flapper motor. On the cassette cover 123, first and second alignment ribs 157 and 158 respectively having different heights are arranged substantially in parallel with the sheet discharge direction, and the upper edge of the first alignment rib 157 near the base wall 156 is set to be lower than that of the second alignment rib 158 far from the base wall 156.

As shown in FIG. 19, the first alignment rib 157 is located at the position slightly exceeding the length of the shorter edge of the postal card and corresponding to ⅔ or more of the shorter edge of the A5-sized sheet, and the second alignment rib 158 is located at the position slightly exceeding the length of the shorter edge of the B5-sized sheet and corresponding to ⅔ or more of the shorter edge of the A4-sized sheet.

If the width of the sheet P horizontally held by the sheet discharge roller 105, the spur 106 and the flapper 107 is wider than the distance between the base wall 156 and the second alignment rib 158, such the sheet P is held by the second alignment rib 158. If the width of the sheet P is narrower than the distance between the base wall 156 and the second alignment rib 158 and wider than the distance between the base wall 156 and the first alignment rib 157, the position of the width direction of the sheet P is controlled by the side surface of the second alignment rib 158. Further, if the width of the sheet P is narrower than the distance between the base wall 156 and the first alignment rib 157, the position of the width direction of the sheet P is controlled by the side surface of the first alignment rib 157.

Next, if the flapper 107 is lowered by the rotation of the not-shown flapper motor, the side edge Pa on the base side of the transported sheet P is dropped on the cassette cover 123, whereby the entire sheet is stacked on the cassette cover 123.

As described above, the height of the first alignment rib 157 is lower than the height of the second alignment rib 158. Thus, if the A4-sized sheet is used, this sheet slides along the upper edges of the first and second alignment ribs 157 and 158 and comes into contact with the base wall 156. If the B5-sized sheet is used, this sheet collides against the side surface of the second alignment rib 158, and the collided sheets are thus aligned. If the A5-sized sheet is used, this sheet slides along the upper edge of the first alignment rib 157 and comes into contact with the base wall 156. If the postal card is used, this card collides against the side surface of the first alignment rib 157, and the collided cards are thus aligned. After then, the following sheets and cards are similarly aligned and stacked. It should be noted that the number of the alignment ribs is not limited to two, that is, three or more alignment ribs may be disposed.

As explained above, the sheet discharge unit of the present embodiment drops the sheets on the cassette cover 123, holds the dropped sheets by the alignment ribs 157 and 157 of different heights, and catches the held sheets by the base wall 156, whereby the sheets never overlap before ink on the sheets dries, and the images recorded on the sheets are never damaged. Further, the sheets never rub together and curl, whereby the side edges of the sheets can be effectively aligned. Moreover, as shown in FIG. 20, the sheets are held by the first and second alignment ribs 157 and 158, whereby the sheet can be easily taken out by inserting a fingertip into a space A between the lower surface of the sheet P and the cassette cover 123. Besides, inclined planes 157*a* and 158*a* are formed respectively on the upstream sides of the first and second alignment ribs 157 and 158 so that the sheet P can be manually fed easily from the cassette cover 123.

Figure 21:
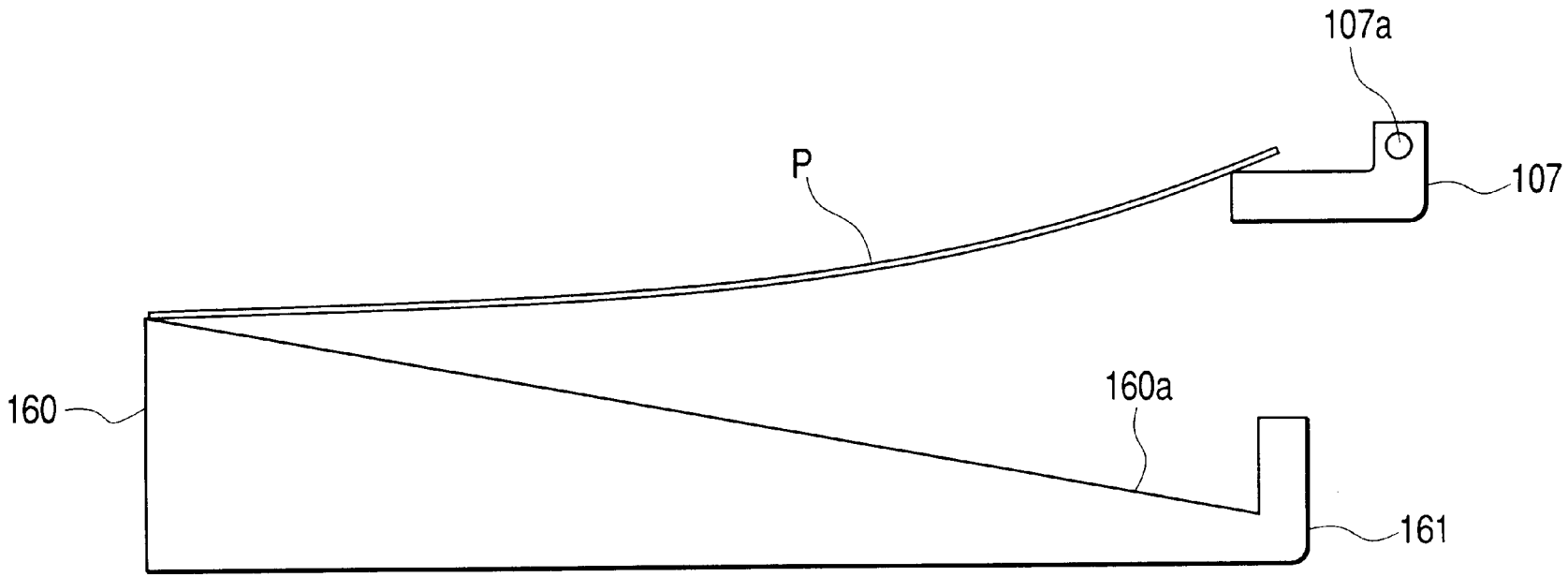
FIG. 21 is a front view showing a modified example of the sheet discharge unit.
Figure 22:
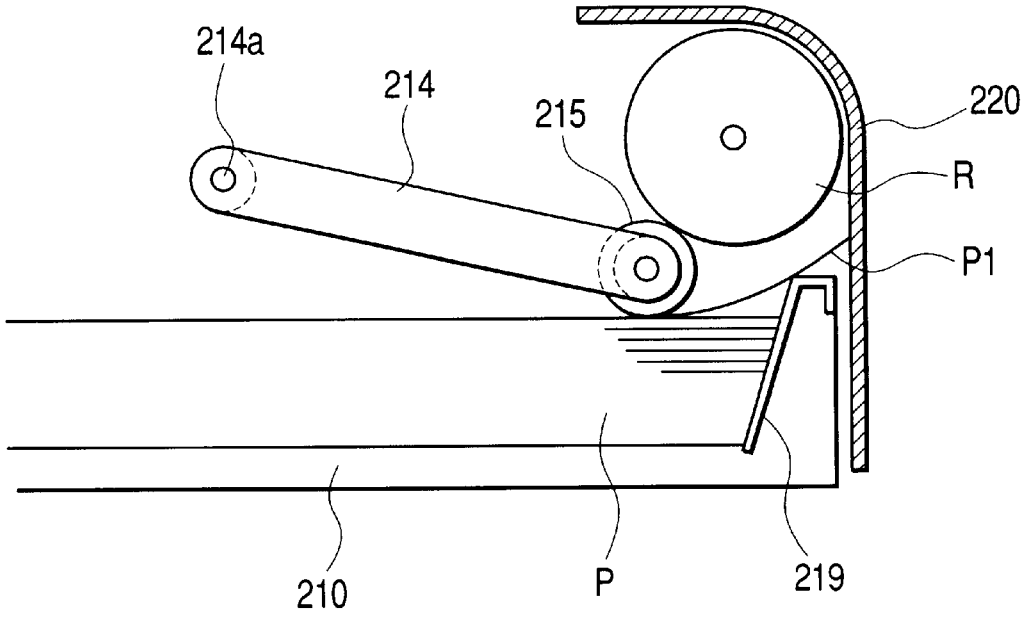
FIG. 22 is a sectional view showing the schematic structure of a conventional sheet feed apparatus.

As shown in FIG. 21, instead of the alignment rib, an inclined plane 160*a* which lowers as it approaches a base wall 161 may be disposed on a cassette cover 160. In this case, the entire sheet can be held irrespective of sheet sizes.

In the above embodiments, the present invention is applied to the serial-type recording apparatus which moves the recording head in the main scanning direction. However, the present invention is also applicable to a full-line-type recording apparatus which records an image as serially transporting a recording sheet by using a recording head entirely extending along the sheet width direction.

Further, in the above embodiments, the example that the recording head of so-called BJ (bubble-jet) system, in various ink-jet systems, is used was explained. However, the present invention is not limited to such a recording system of the recording head but is applicable to various recording systems. As the recording system of the recording head, for example, a piezoelectric system can be used besides the BJ system. Further, in addition to the recording head of the ink-jet system, a recording head of system having various recording elements such as a recording head of thermal transfer system or the like can be used.

As explained above, according to the embodiments, among the plural inclined plane members to separate the sheets fed by the sheet feed roller, the height of the inclined plane member at the position corresponding to the sheet feed roller is set to be lower than that of the other inclined plane members, the inclined plane members do not come into contact with the sheet feed roller when the sheet stacking means is installed in and released from the main body of the apparatus. Moreover, since the other inclined plane members can be made high, the sheet can be surely fed without any fold of its leading edge.

Moreover, since the reversal roller to reverse the sheet fed by the sheet feed roller is provided and each of the plural roller units of the reversal roller is disposed between the inclined plane members, the height of the apparatus can be lowered as a whole.

What is claimed is:

1. A sheet feed apparatus comprising:

sheet stacking means for stacking sheets, said sheet stacking means being able to be installed in and released from a main body of said sheet feed apparatus;

a sheet feed roller for feeding the sheets stacked on said sheet stacking means; and plural inclined plane members, disposed at the end of the downstream side of a sheet feed direction of said sheet stacking means, for coming into contact with the sheets fed by said sheet feed roller to separate them, wherein, among said plural inclined plane members, the height of the inclined plane member corresponding to said sheet feed roller is set to be lower than the height of the other inclined plane members.

2. An apparatus according to claim 1, wherein, when said sheet stacking means is installed in and released from the main body of said apparatus, said inclined plane member corresponding to said sheet feed roller does not come into contact with said sheet feed roller.

3. An apparatus according to claim 2, further comprising:

a support member for rotatably supporting said sheet feed roller; and movement means for rotating said support member when said sheet stacking means is installed in and released from the main body of said apparatus.

4. An apparatus according to claim 3, wherein, when said sheet stacking means is installed in the main body of said apparatus, said movement means sets said sheet feed roller apart from said inclined plane member through said support member, and thereafter moves said sheet feed roller to a position capable of being in contact with the sheets on said sheet stacking means.

5. A recording apparatus which performs recording on a sheet by a recording head, comprising:

a head mounting means for mounting said recording head;

sheet stacking means for stacking the sheets, said sheet stacking means being able to be installed in and released from a main body of said sheet feed apparatus;

a sheet feed roller for feeding the sheets stacked on said sheet stacking means; and plural inclined plane members, disposed at the end of the downstream side of a sheet feed direction of said sheet stacking means, for coming into contact with the sheets fed by said sheet feed roller to separate them, wherein, among said plural inclined plane members, the height of the inclined plane member corresponding to said sheet feed roller is set to be lower than the height of the other inclined plane members.

6. An apparatus according to claim 5, wherein, when said sheet stacking means is installed in and released from the main body of said apparatus, said inclined plane member corresponding to said sheet feed roller does not come into contact with said sheet feed roller.

7. An apparatus according to claim 6, further comprising:

a support member for rotatably supporting said sheet feed roller; and movement means for rotating said support member when said sheet stacking means is installed in and released from the main body of said apparatus.

8. An apparatus according to claim 7, wherein, when said sheet stacking means is installed in the main body of said apparatus, said movement means sets said sheet feed roller apart from said inclined plane member through said support member, and thereafter moves said sheet feed roller to a position capable of being in contact with the sheets stacked on said sheet stacking means.

9. A sheet feed apparatus comprising:

sheet stacking means for stacking sheets;

a sheet feed roller for feeding the sheets stacked on said sheet stacking means;

plural inclined plane members, disposed at the end of the downstream side of a sheet feed direction of said sheet stacking means, for coming into contact with the sheets fed by said sheet feed roller to separate them; and a reversal roller for reversing the sheet fed by said sheet feed roller, wherein said reversal roller has plural roller units, said roller units come into contact with the sheet, and said roller units are disposed at a position opposed to a surface, provided between said inclined plane members, made lower in height than that of said inclined plane member.

10. An apparatus according to claim 9, wherein said sheet feed roller is disposed at a position corresponding in a sheet width direction to one of said plural inclined plane members.

11. An apparatus according to claim 10, wherein said sheet feed roller includes the plural roller units, and a first roller unit among said plural roller units is disposed at a position corresponding to the center of the shorter side of a postal card in case of transporting the postal card in a longitudinal direction.

12. An apparatus according to claim 11, wherein a distance between a second roller unit among said plural roller units and a center of a B-5 sized sheet in the width direction thereof is equal to a distance between said first roller unit and a center of a B-5 sized sheet in the width direction thereof.

13. An apparatus according to claim 9, wherein said sheet stacking means can stack the sheets of plural sizes on the basis of one side portion of the width direction of the sheet, and has the inclined plane members at positions corresponding to the respective edges of the sheets of plural sizes.

14. A recording apparatus which performs recording on a sheet by a recording head, comprising:

a head mounting means for mounting said recording head;

sheet stacking means for stacking the sheets;

a sheet feed roller for feeding the sheets stacked on said sheet stacking means; and plural inclined plane members, disposed at the end of the downstream side of a sheet feed direction of said sheet stacking means, for coming into contact with the sheets fed by said sheet feed roller to separate them; and a reversal roller for reversing the sheet fed by said sheet feed roller, where said reversal roller has plural roller units, said roller units come into contact with the sheet, and said roller units are disposed at a position opposed to a surface, provided between said inclined plane members, made lower in height than that of said inclined plane member.

15. An apparatus according to claim 14, wherein said sheet feed roller is disposed at a position corresponding in a sheet width direction to one of said plural inclined plane member.

16. An apparatus according to claim 15, wherein said sheet roller includes the plural roller units, and a first roller unit among said plural roller units, and a first roller unit among said plural roller units is disposed at a position corresponding to the center of the shorter side of a postal card in case of transporting the postal card in a longitudinal direction.

17. An apparatus according to claim 16, wherein a distance between a second roller unit among said plural roller units and a center of a B-5 sized sheet in the width direction thereof is equal to a distance between said first roller unit and a center of a B-5 sized sheet in the width direction thereof.

18. An apparatus according to claim 14, wherein said sheet stacking means can stack the sheets of plural sizes on the basis of one side portion of the width direction of the sheet, and has the inclined plane members at positions corresponding to the respective edges of the sheets of plural sizes.

* * * * *

UNITED STATES PATENT AND TRADEMARK OFFICE

CERTIFICATE OF CORRECTION

PATENT NO. : 6,651,974 B2
DATED : November 25, 2003
INVENTOR(S) : Makoto Kawarama et al.

It is certified that error appears in the above-identified patent and that said Letters Patent is hereby corrected as shown below:

Column 2,
Line 22, “ax making” should read -- making --.

Column 12,
Line 53, “to” should read -- by --.

Column 13,
Line 65, “157 of” should read -- 158 of --.

Column 14,
Line 28, “of system” should read -- of a system --.
Line 29, “of thermal” should read -- of a thermal --.

Column 15,
Line 12, “sheets” should read -- sheets stacked --.

Column 16,
Line 45, “sheet” should read -- sheet feed --.

Signed and Sealed this

Thirteenth Day of April, 2004

JON W. DUDAS
*Acting Director of the United States Patent and Trademark Office*